US007043329B2

(12) United States Patent
Dias et al.

(10) Patent No.: US 7,043,329 B2
(45) Date of Patent: May 9, 2006

(54) PRESSURE GARMENT

(75) Inventors: Tilak Dias, Stockport (GB); William Cooke, Congleton (GB); Anura Fernando, Cheadle (GB); Dimuth Jayawarna, Lancashire (GB); Najmal Hassan Chaudhury, Sale (GB)

(73) Assignee: The University of Manchester, Manchester (GB)

( * ) Notice: Subject to any disclaimer, the term of this patent is extended or adjusted under 35 U.S.C. 154(b) by 0 days.

(21) Appl. No.: 10/839,981

(22) Filed: May 6, 2004

(65) Prior Publication Data

US 2005/0049741 A1 Mar. 3, 2005

Related U.S. Application Data

(63) Continuation-in-part of application No. PCT/GB02/04909, filed on Oct. 29, 2002.

(30) Foreign Application Priority Data

Nov. 6, 2001 (GB) ..... 01/26554

(51) Int. Cl.
*G06F 19/00* (2006.01)

(52) U.S. Cl. ..... 700/141; 66/55

(58) Field of Classification Search ..... 700/141; 66/178 A, 55; 602/55, 62, 63
See application file for complete search history.

(56) References Cited

U.S. PATENT DOCUMENTS 4,180,065 A * 12/1979 Bowen ..... 602/63
4,502,301 A 3/1985 Swallow et al.
4,527,402 A * 7/1985 Swallow et al. ..... 66/55

FOREIGN PATENT DOCUMENTS

EP 0 640 707 A1 3/1995
FR 2 781 816 A 2/2000
GB 2 309 709 A 8/1997

* cited by examiner

*Primary Examiner*—John J. Calvert
*Assistant Examiner*—Brian Kauffman
(74) *Attorney, Agent, or Firm*—Wallenstein Wagner & Rockey, Ltd.

(57) ABSTRACT

There is disclosed a method for making a pressure garment, comprising the steps of:

defining 3D shape and pressure profile characteristics of a garment;

specifying a knitting pattern for the garment;

calculating yarn feed data for the knitting pattern to produce the defined shape and pressure profile characteristics; and, knitting the garment according to the knitting pattern and the yarn feed data.

33 Claims, 10 Drawing Sheets

PRESSURE GARMENT

CROSS-REFERENCE TO RELATED APPLICATION

This application is a continuation-in-part of International Application No. PCT/GB02/04909 filed 29 Oct. 2002, incorporated herein by reference, claiming priority from Great Britain Application No. GB01/26554.5 filed 6 Nov. 2001, incorporated herein by reference.

BACKGROUND OF THE INVENTION

1. Field of the Invention

This invention relates to pressure garments and methods for making them. By the term "pressure garments" is meant garments which apply pressure to specific areas of the human or animal body for medical reasons, such as the management or treatment of venous ulceration, lymphoedema, deep vein thrombosis or burns, or for operational reasons such as in G-suits or sportswear.

2. Description of the Prior Art

Conventionally, pressure garments are made as simple structures such as support hose, where the requirement is expressed as being simply to apply a level of pressure which is adequate but not too much, and this is achieved by experience or by trial and error. Of course, a given size of support hose will stretch more on patients with heavier build than on those of slight build, and since the degree of pressure exerted depends on the degree of stretch, a heavier built patient will experience more pressure than a lighter built patient, and the notion of "one size fits all" works out in practice as "one size fits nobody perfectly".

G-suits, and in particular space suits, tend to be custom made and are fitted with dynamic pressure control, for example to compress the lower body under high downward gravitational loading in order to prevent drainage of blood from the brain to the lower body. These garments are very expensive.

SUMMARY OF THE INVENTION

The present invention provides new methods for making pressure control garments that enable custom designed garments to be made quickly and accurately to give medically-prescribed pressure regimes.

This invention comprises a method for making a pressure garment, comprising the steps of:

- defining shape and pressure characteristics of a garment;
- specifying a knitting pattern for the garment;
- calculating yarn feed data for the knitting pattern to produce the defined shape and pressure characteristics; and,
- knitting the garment according to the knitting pattern and the yarn feed data.

The shape characteristics may be defined by way of generating a plurality of discrete points (a "point cloud") which define the body or part thereof for which the garment is intended.

In one embodiment, the shape characteristics are defined with reference to data derived from scanning the body or part thereof for which the garment is intended.

In another embodiment, the shape characteristics are defined using CAD images of input data. The input data may be, for example, measurements made of the body or part thereof for which the garment is intended.

In another embodiment still, the shape characteristics are defined with reference to a plurality of two dimension images of the body or part thereof for which the garment is intended. Typically, a plurality of images from different angles and/or elevations may be used. A point cloud may be generated from the plurality of two dimension images, the point cloud being used for subsequent processing such as by a CAD system.

The pressure profiles and characteristics may be defined from medical considerations—a medically qualified person may, for example, decide to prescribe that a certain pressure be applied over a certain area, and may operate a 3D body scanner, which may be of a commercially available type, or which may be specially developed for this purpose, to define the 3D shape and dimensions of the garment, and scanned data that may be in the form of a point cloud may then be transmitted to a CAD system for defining pressure profiles and characteristics. The CAD system calculates yarn feed data and the knitting pattern. The scanning environment may be remote from the CAD system, data being transmitted by any convenient means such as by e-mail.

CAD system calculated data may be transmitted to a manufacturing operation, which may, again, be remote from the CAD system, data, again, being transmitted by any convenient means.

Point cloud data representing 3D shape characteristics may be processed to generate an image of the 3D shape the garment has to fit, and pressure profiles and characteristics may then be used to calculate machine and/or knitting parameters. The point cloud data may be used to calculate the number of needles per course for knitting the garment. The data may be overlaid with simulated needle points of a knitting machine to be used for making the garment. The garment may be knitted on an electronic flat bed knitting machine or a circular knitting machine.

The knitting machine and yarn delivery system may be controlled for the formation of each stitch, tuck or float of the knitting pattern according to the calculated yarn feed data. The garment may be manufactured as a 3D seamless garment.

The elastic extensibility of the knitted garment may be a combination of yarn elongation and deformation of knitted structure in the garment. This may give the predetermined pressure profile and characteristics on elastic extension, affected by donning the garment.

The garment may be knitted using low modulus yarn, which may be polymer and/or metal yarn having linear and/or non-linear tension/extension characteristics. The yarn may, for example, increase or decrease its modulus of elasticity on elevation of its temperature from ambient or specified temperature to body temperature.

The invention also comprises garments made by the methods of the invention, such as pressure stockings.

The invention also comprises apparatus for making pressure garments comprising data processing means adapted to calculate yarn feed data for a specified knitting pattern based on defined shape and pressure characteristics of a garment, and a knitting machine controlled to knit the garment according to the knitting pattern and the yarn feed data.

The knitting machine may be an electronic flat bed machine or a circular knitting machine.

The knitting machine may be remote from the data processing means, with a data link of some description, for example, e-mail, transmitting the data to the knitting machine.

The apparatus may also include scanning means for deriving 3D shape and dimensions from the human or animal body the garment is intended for. The scanning means may be remote from the data processing means, information about the 3D shape and dimensions together with prescribed pressure profiles and its characteristics being transmitted to the data processing means, again by any suitable link. Advantageously, the scanning means collects point cloud data representing shape characteristics from the human or animal body the garment is intended for.

The garment may be knitted with an elastomeric yarn. In preferred embodiments the elastomeric yarn comprises an elastomeric core yarn and substantially inelastic outer yarn which sheathes the core yarn.

Surface boundary lines representing the 3D shape and dimensions of the body or part thereof for which the garment is intended may be defined. The surface boundary lines may be defined using a polynomial function. Algorithms such as least squares fitting and Hermite cubic splines algorithms may be used for this purpose. A course path representing the courses of the knitted garment may be defined and mapped onto the surface boundary lines. A polynomial function may be used to define the course path.

The defined pressure profile characteristics may be produced by controlling yarn strain in the courses of the knitted garment. Yarn strain may be controlled by controlling the course lengths in the knitted garment. Advantageously, yarn strain is controlled by controlling the number of needles knitted in each course.

The knitting of the garment according to the knitting pattern provides a fabric. It is preferred to knit the garment to produce a knitted structure having stitches and tucks. In this way, a stiffer fabric structure can be produced. An example of a suitable fabric structure is a honeycomb structure. Such a structure can be produced by knitting a knitted structure which comprises alternate stitches and tucks.

BRIEF DESCRIPTION OF THE DRAWINGS

Methods for making pressure garments, garments made thereby and apparatus therefor will now be described with reference to the accompanying drawings, in which.

DETAILED DESCRIPTION OF THE INVENTION

The drawings illustrate making a pressure garment comprising the steps of:

defining shape and pressure characteristics of a garment specifying a knitting pattern for the garment calculating yarn feed data for the knitting pattern to produce the desired shape and pressure characteristics; and, knitting the garment according to the knitting pattern and the yarn feed data.

Figure 1:
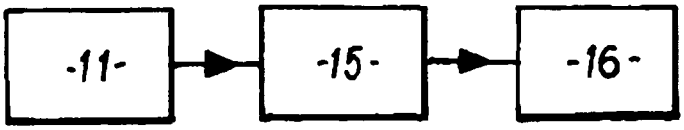
FIG. 1 is a diagrammatic illustration of a manufacturing system incorporating the various aspects of the invention.

The 3D shape and the dimensions are defined in a body scanner environment 11, FIG. 1. The part of the body at issue is scanned to determine its shape and dimensions—see FIG. 2 (e.g., the leg is being scanned by a commercially available scanner 12).

Figure 2:
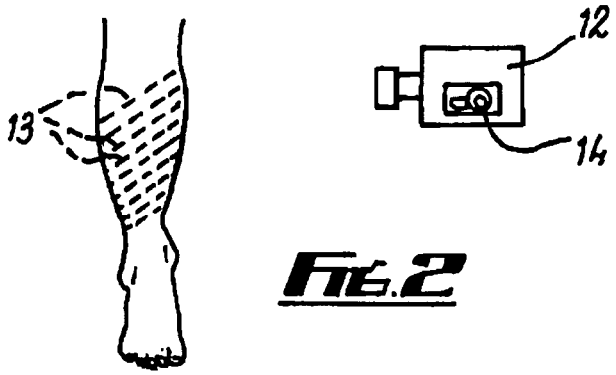
FIG. 2 is a view of a scanning arrangement deriving shape characteristics from a leg for which a pressure garment is to be prescribed.

Pressure profiles and characteristics may be defined on the 3D scanned image. This information is matched with a suitable knitting pattern. In FIG. 2, the leg with lines corresponding to course lines in the finished garment which the medical practitioner may colour code (if it is a colour scanner) or make darker or lighter shades to indicate a pressure profile, adding, perhaps, legend denoting what pressure is meant by a certain colour or thickness of marking. The scanner 12 can store its data on, for example, a CD or file server 14, which can be down loaded via any suitable means, e.g., e-mail, intranet or Internet to a CAD system 15 which may be remote from the scanning environment.

On the CAD system 15, the scanned data is used to generate a 3D image of the body part onto which the medical practitioner may map the required pressure profiles. The 3D shape data can be used to produce a screen image, for example, of the required garment, which may be a 2D or 3D image, and overlie it with simulated needle points of the knitting machine for which the pattern is intended. The yarn feed for each stitch, tuck or float of the pattern may be calculated by a suitable algorithm to produce the required pressure profiles and characteristics.

Figure 3:
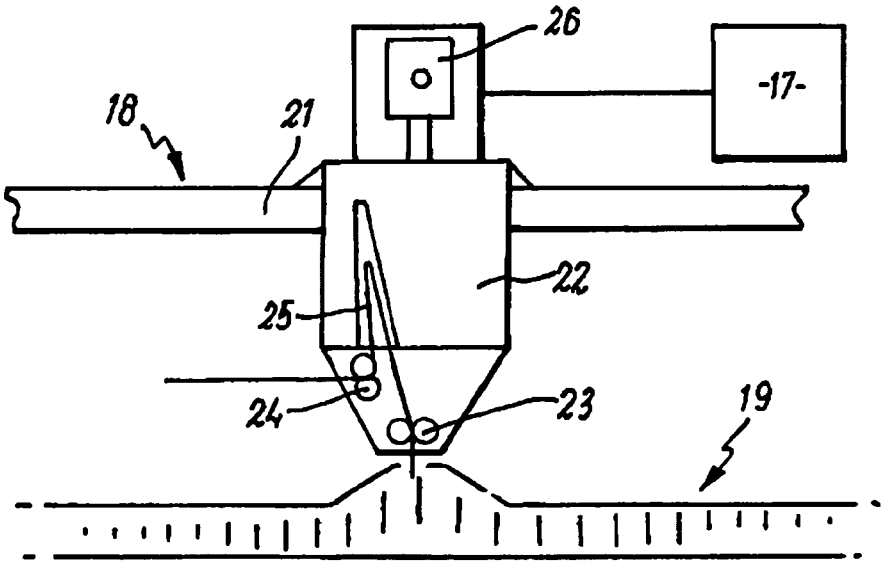
FIG. 3 is a diagrammatic illustration of a yarn feed arrangement of an electronic flat bed knitting machine used in the method of the invention.

The knitting pattern, in the form, now, of instructions to control the knitting machine, together with the yarn feed data, and together with the patient data, machine data, yarn data and any other relevant information is transmitted to a manufacturing facility 16 and loaded into a flat bed knitting machine controller 17, FIG. 3.

FIG. 3 illustrates diagrammatically a flat bed knitting machine 18 with a needle bed 19 and a rail 21 along which runs a yarn feeder 22 which has yarn feed wheels 23 controlled by a precision servo motor 26 together with a pneumatic yarn reservoir fed by yarn feed wheels 24 in which a loop of yarn 25 is held available for rapidly varying feeding rates to the needles at various stages of the knitting so as to put precisely the right amount of yarn into each stitch, tuck or float. The pneumatic reservoir is to hold the yarn under near zero uniform tension—the yarns used in the manufacture of pressure garments are elastomeric, tension-sensitive yarns.

The application of the invention to the production of a compression stocking will now be described. The skilled reader will appreciate that the invention can be applied to the manufacture of other types of pressure garment. The pressure created by a compression stocking on a leg is primarily due to the local tension in the elastomeric fabric that is used to produce the stocking. By stretching the fabric a tension is created and when the path of this tensile force is curved, it creates a pressure on the curved contact surface. The relationship between the stretch and the tension in the fabric is determined by the construction of the fabric structure. Hence, in the design of a compression stocking, one must select a fabric having suitable stress strain characteristics.

The basic material required to create a compression stocking is the stretch fabric. The structure of this fabric is selected to give the required stiffness and surface frictional properties. Yarn selection for this structure is of importance too as this and the yarn path decides the fabric stiffness and the surface properties. To exhibit good fabric handling characteristics the yarn used should be fine. In preferred embodiments garments are knitted with a covered yarn consisting of an outer inelastic yarn and an elastomeric core yarn. Use of a covered elastomeric yarn in this case is beneficial since the covering yarn can be selected to be resistant to detergents, thereby protecting the yarn, and also can provide stiffness to the elastomeric yarn. A further advantage is that such yarns are generally easier to knit.

Another consideration is the surface roughness provided by the fabric. In some instances, a pressure stocking has a wadding layer underneath it to pad the leg and to prevent the fabric from direct contact with the ulcerated area. In other instances, the fabric of the stocking layer is in direct contact with the leg. In either instance, pressure treatment stockings need to have enough friction with the surface underneath the stocking fabric to prevent the stocking from sliding down the leg when the person is mobile. Hence an acceptable level of friction too is desired from the fabric. This friction is facilitated by the yarn and the structure used to construct the compression garment. The frictional properties of the covering yarn and the yarn surface the structure presents provide the required frictional properties for the wearing of compression stockings. This is because a certain minimum fabric to skin friction is required to prevent the stocking from moving down the leg.

The selection of suitable fabrics and constituent yarn is well within the ambit of the skilled reader. Examples of possible yarns are 'D992 A' type (A yarn) and the 'D992 B' type (B yarn) covered elastomeric yarns. Details of these yarns are provided in Table 1 and Table 2 below.

TABLE 1

Details of A type yarn

| Yarn | D992 A (Double covered) | |
|---|---|---|
| Core | 570 D'T LYCRA T 902C | 50% |
| Inner cover | 33/10 TEXT NYLON 66 | 14% |
| Outer cover | 84/30 VISCOSE | 36% |
| Extension % | 330 @ 170 | 35460 Meters/Kg<br>40 stretched<br>282 resultant D'tex |

TABLE 2

Details of B type yarn

| Yarn | D992 B (Double covered) | |
|---|---|---|
| Core | 570 D'T LYCRA T 902C | 55% |
| Inner cover | 33/10 TEXT NYLON 66 | 15% |
| Outer cover | 67/24 VISCOSE | 30% |
| Extension % | 330 @ 170 | 35460 Meters/Kg<br>40 stretched<br>260 resultant D'tex |

By feel it was observed that the 'B' type yarn had higher frictional properties than the 'A' type yarn. Using both yarns 'A' and 'B', elastomeric plain knit fabric tubes were knitted. These tubes were tested for their friction on the skin when worn. From the resulting observations it was decided that the fabrics knitted with 'A' type yarn has lower frictional properties than the 'B' type yarn incorporated fabrics. Also the fabric knitted with the 'A' type yarn felt much more comfortable on the skin than the 'B' type yarn fabric. On these judgements it was decided to use the 'A' type yarn and develop a suitable knitted structure to give the performance required. However, the 'B' type yarn—or any other suitable yarn—might instead be used according to the principles of the invention.

Figure 4:
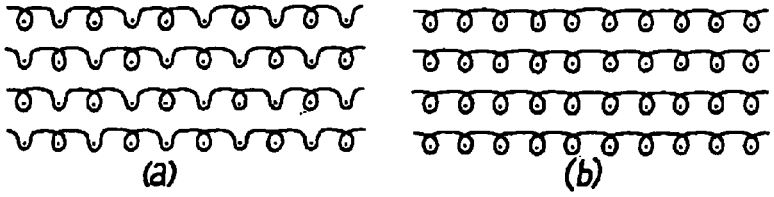
FIG. 4 shows stitch notations for (a) a honeycomb structure and (b) a plain knitted structure.

Two fabrics were knitted using the 'A' yarn. The fabrics were of a honeycomb structure 40 depicted in FIG. 4(*a*) and a plain knit structure 42 depicted in FIG. 4(*b*). Load curve data were obtained for both fabrics. The honeycomb structure consists of alternative stitches and tucks.

The pressure given by the stocking is a direct result of the stiffness of the fabric, its working strain and the surface radii at which the pressure is applied. Usually the stocking needs to operate under less than 0.5 strain as beyond this it will be difficult to pull a stiff stocking over the heel of the foot.

The accepted formula to calculate the sub bandage pressure is derived from the Laplace equation as follows;

$$P=(TN\times 4630)/CW$$

where P=pressure (in mmHg)
T=bandage tension (in kgf)
C=circumference of the limb (in cm)
W=bandage width (in cm)
N=number of layers applied Using the above equation, assuming a minimum radius of curvature of 25 mm, a course height of 0.3 mm, to get a pressure of 40 mmHg the tension needs to be approximately 0.0041 N. A pressure of 40 mmHg is generally considered to represent the 'gold standard' for compression bandaging.

From the above calculation and the load curve data it was observed that the honeycomb structure is suited better for use in a compression stocking. However, the invention is not limited to the honeycomb structure. Rather, other combinations of knitted structures/yarn are within the scope of the invention.

Experimental pressure values at a specific radius of curvature and strain were obtained by putting fabric tubes on a cylindrical surface and measuring the pressure exerted by the fabric. An Oxford Pressure Monitor (RTM) sensor system (Tally Medical Limited, Romsey, UK) was used to measure the pressures, this being the industry standard for measuring pressures on the legs of ulcer patients.

Elastomeric fabric tubes of the honeycomb structure were knitted to different circumferential lengths and to a height of approximately 200 mm. Next the fabrics were washed at 40° C. and tumble dried. These were mounted on the pressure test rig providing cylindrical surfaces of various diameter. An Oxford Pressure Monitor sensor was placed underneath the fabric. Then the fabric was left for one hour before the pressure readings were recorded. For each pressure reading, the relevant strain and the radius of curvature of the cylinder too were recorded. Table 3 shows the data obtained on the honeycomb structure, where e %=strain percentage R=Radius of curvature (mm)

P=Pressure in mmHg

TABLE 3

Honeycomb structure load curve theoretical data

| R = 24 | | R = 43 | | R = 57 | | R = 64 | | R = 76 | | R = 100 | | R = 115 | |
|---|---|---|---|---|---|---|---|---|---|---|---|---|---|
| E % | P | e % | P | e % | P | e % | P | e % | P | e % | P | e % | P |
| 0 | 0 | 0 | 0 | 0 | 0 | 0 | 0 | 0 | 0 | 0 | 0 | 0 | 0 |
| 5 | 2 | 18 | 10 | 10 | 2 | 12 | 0 | 20 | 7 | 16 | 2 | 23 | 3 |

Hence a model is specified for the region $$5 \leqq (\text{strain} \times 100) \leqq 100$$

$$24 \leqq R \leqq 150$$

To create the empirical pressure profile for the honeycomb structure, polynomial curves of $3^{rd}$ order are fitted to the constant data columns.

$$P_{R24} = \sum_{0}^{3} a_n(\text{Strain} \times 100)^n$$

$$P_{R43} = \sum_{0}^{3} b_n(\text{Strain} \times 100)^n$$

$$P_{R57} = \sum_{0}^{3} c_n(\text{Strain} \times 100)^n$$

$$P_{R64} = \sum_{0}^{3} d_n(\text{Strain} \times 100)^n$$

$$P_{R76} = \sum_{0}^{3} f_n(\text{Strain} \times 100)^n$$

$$P_{R100} = \sum_{0}^{3} g_n(\text{Strain} \times 100)^n$$

$$P_{R115} = \sum_{0}^{3} k_n(\text{Strain} \times 100)^n$$

Intersection points defined by these curves and the seven radius values are used to generate $3^{rd}$ order polynomial curves for a series of (strain percentage) values varying by one unit up to 100.

Figure 5:
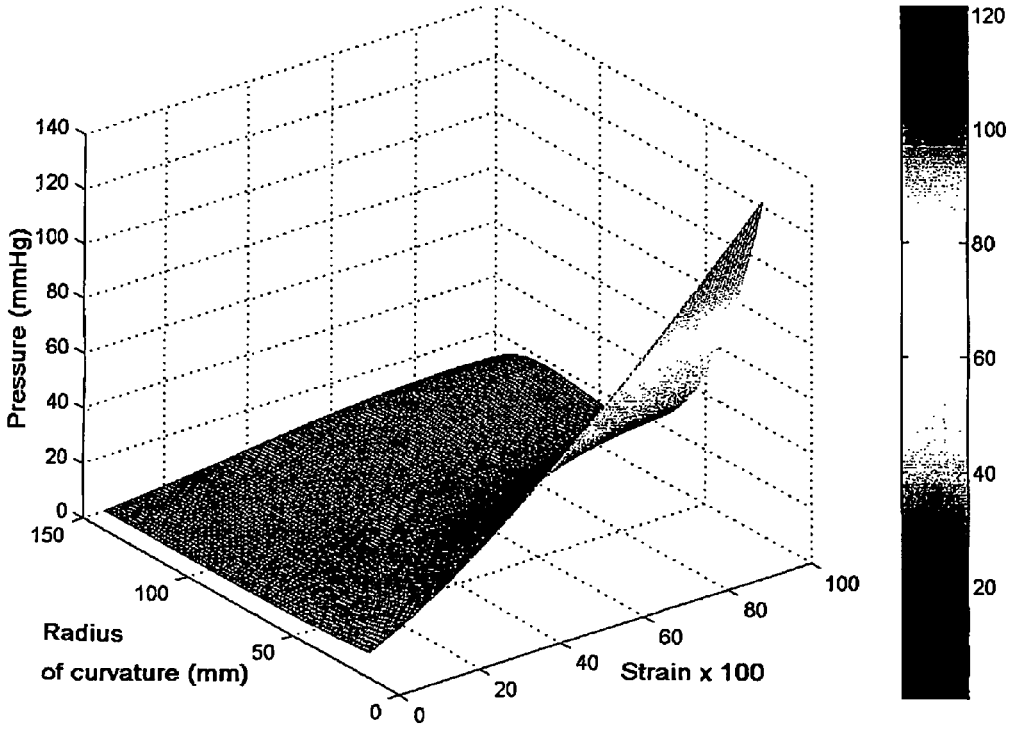
FIG. 5 shows a pressure profile for a honeycomb fabric structure.

The intersecting point on these curves is used in a MatLAB program to define the pressure profile, which is shown in FIG. 5.

Since this pressure profile is created through surface interpolation of 3D experimental data, this profile is considered to have the high degree of accuracy. Furthermore, the method represents a model which can be applied to many fabrics that could be used for the design of stockings with engineered compression profiles.

Stretch fabrics are created for different yarn types, stitch lengths and fabric structure variables. Creation of more samples with different combinations of these variables enriches the fabric structure database. Each variable combination is identified as material variables. With each material variable, fabric tubes are created and the pressure imparted by them at different strain values and radius of curvatures are recorded as before. Pressure models calculated for material variables gives possible fabrics for use in the stocking.

Selection of a suitable material pressure model is based on the Laplace equation as before. That is, for each of the material, for a minimum radius of curvature of 25 mm, a course height of 0.3 mm, to get a pressure of 40 mmHg the tension is calculated (0.0041 N). The material that achieves this tension at the lowest strain can be selected as a suitable compression stocking structure.

A system for producing engineered compression garments using 3 dimensional scanning involves modelling the surface of the leg using a single point cloud given by the 3 dimensional scan, together with the determination of radius of curvatures on the surface of the leg, determination of fabric cross sectional lengths at each cross section and the analysis of the pressure effect of a shaped stretch fabric tube worn on the leg with or without wadding underneath. In this approach, mathematical models are solved using a software program created to automate the calculation process. Images are generated to visualise the knitted fabric wrapped around the leg, the radius of curvature profile of the leg and the pressure profile of the leg on the application of a graduated pressure distribution along a vertical surface line on the fabric tube. The modelling recognises the requirement for having the boundary conditions of zero force at the top end of the stocking, zero force on the ankle cross section of the stocking, that the fabric is relaxed along the height direction of the tube, and that yarn migration from one course to the other does not occur.

A suitable stretch fabric model calculated as described earlier was used as the input data. This model is used to predict the empirical model of the fabric pressure performance against the strain percentage in the course direction and the contact radius of curvature of the leg surface profile. Leg profile is modelled mathematically from the Cartesian point cloud received from a leg scanner producing a 3D surface definition of the leg. A course path is defined on this points selected on the surface and a stitch map of the course path is defined on the course path. The radius of curvature of the surface along the course path is calculated from the Cartesian coordinates and these results are used together with the fabric pressure performance model to generate the theoretical pressure profile created as a result of the stretch fabric. By defining the pressure expected from each of the course at a particular point on the same course, the relevant course length of the stocking is calculated. These data are presented as a 2D surface development image of the 3D-stocking surface, which is used by the electronic flat bed knitting machine to generate the Jacquard pattern for producing the garment.

The scanner technology employed utilises the principles of Moire' fringes. When a body is scanned and Moire fringe technology is used to process the fringe data acquired, the software engine of the off the shelf scanning system is able to output a set of Cartesian coordinates in 3D space. The system developed in this work to engineer the compression stocking uses this set of Cartesian coordinates as the input surface definition.

As an example to illustrate the amount of data that the system must process, it is noted that a scanned leg height of 350 mm would produce a data set consisting of over 26 million points. Also the data does not lie on a single surface but rather a surface shell about 0.5 mm thick. After the reorientation of the data cloud, definition of the fabric path using the entire point cloud under these circumstances is superfluous and time consuming in processing. Hence a data reduction process is used to define a unique path for the fabric and leg surface definition.

Figure 6:
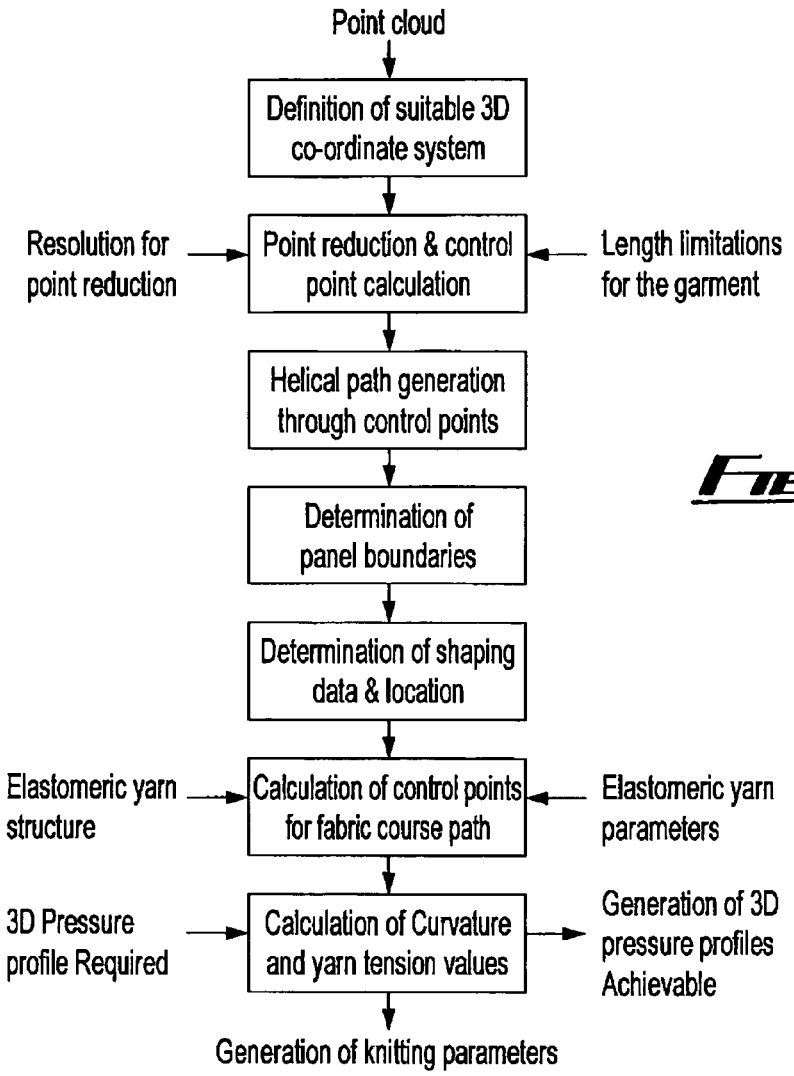
FIG. 6 is a flow diagram depicting the processing sequence in an embodiment of the invention.

For this, leg surface boundary lines are selected all around the leg in the vertical plane. These lines are selected using the Least squares curve definition method and this line is represented by a polynomial function of a suitable order. It was found that a polynomial order of 7 is capable of handling the complex surface curvature in the vertical direction. On this vertical boundary lines the fabric courses are mapped to determine the number of courses in the compression stocking. A course path is generated to create the helical path the fabric course will assume. A course path from the lower extremity to the upper boundary is generated as a multiple piecewise cubic Hermite curve. Curve length for each half revolution of the course is used to generate the needle number for the front and back bed of a circular knitting machine used to produce the garment. FIG. 6 shows a flow diagram depicted the processing sequence of the point cloud information and engineering of the compression garment thereon.

Initially the axis of the raw point cloud is made parallel with the 'z axis' through the origin and then the two axes are made to coincide. Hence all the data points are updated to relate to this new coordinate system. Then the data points are cropped to include only the leg length of the compression stocking. Higher the number of surface boundary lines around the leg, better resolution the modelled fabric course will have and better the mathematical model will show the concave, convex and flat areas on the leg surface. But a higher number of surface boundary lines will increase the data processing time. Hence in this example 24 vertical surface boundary lines were considered, although the invention is not limited in this regard.

Helical course path in this case is defined by the control points calculated on the vertical surface boundary lines. An equal number of courses to fill the height of the stocking along the leg surface is defined by the calculation of the control points spaced at course separation length intervals. Calculation of control points in the clockwise or anti-clockwise direction for the vertical surface boundary lines was staggered to account for the helical angle. Then a piecewise polynomial curve path was defined through these points to represent the wrapping of the course of the fabric tube on the leg.

Cross sectional circumferences of the leg is given by the length of the polynomial curve for each revolution. Assuming a course to be in the same plane, definition of the fabric tension along the particular course could be defined for any point on that cross section. Use of the surface radius of curvature and the required pressure at that point enables the determination of the associated strain percentage from the fabric pressure characteristic model. Definition of boundary pressure and a suitable pressure graduation function enables the determination of strain percentage of each of the course in the compression stocking. This reduced course length is represented by the number of needles in that length by dividing this length by the wale separation number. This information is represented to the knitting machine as a 2D image, which the machine is able to process.

In the UK, design criteria for compression stockings are set by the British standard number BS 6612 1985. However, this standard is more relevant to calculated mean leg surface circumferences at different levels of the leg. The ability provided by the present invention to generate the pressure profile due to a stocking for the real surface radii of curvature extends the pressure garments of the invention beyond the scope of the above standard. Hence the design of "tailor made" compression stockings provided by the invention is guided by their performance requirements.

When a compression stocking is put on a leg, depending on the density of the tissues underneath, the leg surface is reshaped. According to known work, the force vs displacement curve for compression of skin and muscles is of an exponentially increasing profile. The displacement due to compression is seen to become constant with smaller deformation. To account for this, before the scan is taken, a stocking, which would impart high pressure on the leg, is put on the leg to be scanned. It is assumed that the radius of curvatures produced by this modified surface are closer to the final radii of the curvature profile.

It can be seen from FIG. 5 that the observable pressure variation is limited approximately to radii values below 80 mm. Hence to achieve the effect of the pressure definition on the stocking, either the pressure definition needs to be done on lower radius of curvatures or the radii of points with larger radii of curvature needs to be modified to get lower radius values. In view of this, in the example discussed below the stocking pressure definition is performed along the anterior side of the leg.

It should be noted that a pressure gradient is applied only on the leg and not to the foot. Due to the complex shape of the foot, no pressure definition is performed. Rather, a pressure of about 25 mmHg is applied to the foot. Stockings may be designed with an open toe area, and may fit approximately 30 mm below the knee.

A Wicks and Wilson (RTM) prototype 3D leg scanner was employed. The scanning volume of the leg scanner is cylindrical and has a diameter of 300 mm and a height of 450 mm. To take the scan the leg of the subject is positioned in the scanning volume by standing inside the volume with the sole of the foot touching the ground. Because of this, it is impossible to get a single scan of the leg and foot with the definition of the sole of the foot. To create the knitting parameters for the compression stocking consisting of the foot and the leg, two separate scans are taken, and processed separately. This process may not be necessary if other scanners are employed.

To account for the deformation of the leg when the stocking is put on, a strong stocking is put on the subject's leg before scanning and the subsequent marking is done on this stocking. To scan the leg, the subject stands inside the scanning volume of the 3D scanner with the anterior side of the leg forward. The leg of the subject is marked with a felt pen to show the lower limit cross section of the leg at 2 cm above the ankle, the maximum calf circumference cross section, the cross section in between and the height of the stocking. On these cross section marks, the design points are marked. The subject is made to stand so that the anterior of the leg is facing in the forward direction. Once the scan of the leg is taken the data below the lower limit and the data above the upper limit are removed inside the editor of the scanner software. This remaining data file is used to design the leg part of the stocking.

To scan the foot, the subject is made to sit on a low chair and place the leg horizontally in the scanning volume. The foot is oriented so that the scanner captures a side elevation view with the ankle facing forward and with the full foot sole data visible. Once the foot scan is taken, the data above the line marked above the ankle are removed inside the scanner software. The remaining data file is used for designing the foot part of the stocking.

The data point definition of the leg is extracted as a ASCII file by saving the scan image in the ASCII form at. For further processing it is accessed by the work software. As the way a person holds his/her leg upright for scanning is unique at each scanning event, it was observed that the Cartesian coordinates need to be repositioned. This was also of assistance in subsequent image manipulations, since a tilt and a translation distance between an image and the 'z' axis of the coordinate system would be problematic.

Two curve fitting methods have been used to determine the radius of curvature profile, pressure profile and the stocking knitting parameters. These are the "Least squares method" and the "Hermite cubic splines" method. It should be noted that these curve fitting algorithms are provided as examples only, and are not limitations to the invention. The skilled reader will readily appreciate that other curve fitting techniques might be utilised instead.

The least squares method will now be described.

Consider N+1 coordinate points on a 2D plane with abscissas $x_0, x_1, x_2, x_3 \ldots, x_n$ And ordinates $f_0, f_1, f_2, f_3 \ldots, f_n$ Assume the curve that is fitted to these coordinates is p Deviation of the points on the curve from the ordinates is $p(x_i)-f_i$ . . . (1)

If a function were to interpolate the data, then the deviation should be zero. For the sake of using a simple function, a function could be fitted which would result in a certain degree of deviation. In the Least squares method, the square of this deviation is minimised.

The sum of squared deviations are given by $$E(p) = \sum_{i=0}^{N} [p(x_i) - f_i]^2 \tag{2}$$

Let $$p(x)=a_0+a_1x+a_2x^2+\ldots+a_mx^m \tag{3}$$

Where $$\frac{\partial E}{\partial a_i} = 0 \quad \text{for } i = 0, 1, 2, 3, \ldots, m$$

Hence for j=0, 1, 2, . . . , m $$\frac{\partial E}{\partial a_j} = \sum_{i=0}^{N} 2[p(x_i) - f_i]\frac{\partial p(x_i)}{\partial a_j} = 2\sum_{i=0}^{N} x_i^j[p(x_i) - f_i] \tag{4}$$

$$2\left[\sum_{i=0}^{N} x_i^j(a_0 + a_1x + a_2x^2 + \ldots + a_mx^m) - \sum_{i=0}^{N} x_i^j f_i\right] = 0 \tag{5}$$

$$2\left[\left(\sum_{i=0}^{N} x_i^j\right)a_0 + \left(\sum_{i=0}^{N} x_i^{j+1}\right)a_1 + \ldots + \left(\sum_{i=0}^{N} x_i^{j+m}\right)a_m - \left(\sum_{i=0}^{N} x_i^j f_i\right)\right] = 0 \tag{6}$$

This equation can be expanded as $$\begin{aligned} a_0\sum_{i=0}^{N} x_i^0 + a_1\sum_{i=0}^{N} x_i + \ldots + a_m\sum_{i=0}^{N} x_i^m &= \sum_{i=0}^{N} f_i \\ a_0\sum_{i=0}^{N} x_i + a_1\sum_{i=0}^{N} x_i^2 + \ldots + a_m\sum_{i=0}^{N} x_i^{m+1} &= \sum_{i=0}^{N} x_i f_i \\ &\ldots \\ a_0\sum_{i=0}^{N} x_i^m + a_1\sum_{i=0}^{N} x_i^{m+1} + \ldots + a_m\sum_{i=0}^{N} x_i^{2m} &= \sum_{i=0}^{N} x_i^m f_i \end{aligned} \tag{7}$$

In solving these set of simultaneous equations, the coefficients $a_0, a_1, a_2, \ldots, a_m$ is found.

The Hermite cubic splines will now be described. The Hermite cubic splines method is one of the most powerful, flexible computer technique of generating smooth curves and surfaces in CAD/CAM applications. Using this technique, it is possible to interpolate points in a path, if those points, and the starting and finishing curve tangents are known.

The parametric equation of a cubic spline segment is given by $$P(u) = \sum_{i=0}^{3} C_i u^i \text{ where } 0 \le u \le 1 \tag{8}$$

Here 'u' is the parameter and '$C_i$' is the coefficients of the polynomial equation.

The equation can be shown in the scalar form as follows $$\begin{aligned} x(u)&=C_{3x}u^3+C_{2x}u^2+C_{1x}u+C_{0x} \\ y(u)&=C_{3y}u^3+C_{2y}u^2+C_{1y}u+C_{0y} \\ z(u)&=C_{3z}u^3+C_{2z}u^2+C_{1z}u+C_{0z} \end{aligned} \tag{9}$$

In the vector form it is given as $$P(u)=C_3u^3+C_2u^2+C_1u+C_0 \tag{10}$$

where $U=[u^3\ u^2\ u\ 1]^T$ and $C=[C^3\ C^2\ C\ C_0]^T$ $$P(u)=U^TC \tag{11}$$

The tangent vector to the spline curve at any point is given as $$P'(u) = \sum_{i=0}^{3} C_i i u^{i-1} \text{ where } 0 \le u \le 1 \tag{12}$$

Considering the two known end points of the curve, $P_0$ and $P_1$ and their tangents $P'_0$ and $P'_1$ and applying them in the curve polynomial equation and the tangent equation when u=0 and u=1

$$P_0=C_0$$

$$P_0=C_1$$

$$P_1=C_3+C_2+C_1+C_0$$

$$P_1=3C_3+2C_2+C_1 \tag{13}$$

Solving these equations 13 and replacing the $C_i$ values in the curve equation and the tangent equations, when $0 \leqq u \leqq 1$ $$P(u)=(2u^3-3u^2+1)P_0+(-2u^3+3u^2)P_1+(u^3-2u^2+u)P_0+(u^3-u^2)P_1 \tag{14}$$

$$P(u)=(6u^2-6u)P_0+(-6u^2+6u)P_1+(3u^2-4u+1)P_0+(3u^2-2u)P_1 \tag{15}$$

This can be written in the matrix form as $$P(u) = [u^3\ u^2\ u\ 1]\begin{bmatrix} 2 & -2 & 1 & 1 \\ -3 & 3 & -2 & -1 \\ 0 & 0 & 1 & 0 \\ 1 & 0 & 0 & 0 \end{bmatrix}\begin{bmatrix} P_0 \\ P_1 \\ P'_0 \\ P'_1 \end{bmatrix} \tag{16}$$

$$P'(u) = [u^3\ u^2\ u\ 1]\begin{bmatrix} 0 & 0 & 0 & 0 \\ 6 & -6 & 3 & 3 \\ -6 & 6 & -4 & -2 \\ 0 & 0 & 1 & 0 \end{bmatrix}\begin{bmatrix} P_0 \\ P_1 \\ P'_0 \\ P'_1 \end{bmatrix} \tag{17}$$

when $0 \leqq u \leqq 1$

Equation 16 describes the cubic spline path function between two points $P_0$ and $P_1$. This relationship can be generalised for any two adjacent spline segments of a spline curve that should fit number of points. This introduces the joining of cubic spline segments.

Consider j number of control points. When a Hermite cubic spline curve is interpolated to these points, it results in j−1 piecewise cubic spline segments. By applying a second order continuity condition it is possible to find the tangent values related to each point. This means to determine the multiple curves as a one smooth curve, the second derivative of the position vector is considered as continuous.

Considering the $k^{th}$ and $k+1^{th}$ segments, for u between 0 and 1, the relationship between the points and their tangents are derived as follows.

Yarn path is given by the equations $$P_k(u)=(2u^3-3u^2+1)P_{k-1}+(-2u^3+3u^2)P_k+(u^3-2u^2+u)P_{k-1}{}^u+(u^3-u^2)P_k{}^u \tag{18}$$

$$P_{k+1}(u)=(2u^3-3u^2+1)P_k+(-2u^3+3u^2)P_{k+1}+(u^3-2u^2+u)P_k{}^u+(u^3-u^2)P_{k+1}{}^u \tag{19}$$

$$P_k{}^{uu}(u)=(12u-6)P_{k-1}+(-12u+6)P_k+(6u-4)P_{k-1}{}^u+(6u-2)P_k{}^u \tag{20}$$

$$P_{k+1}{}^{uu}(u)=(12u-6)P_k+(-12u+6)P_{k+1}+(6u-4)P_k{}^u+(6u-2)P_{k+1}{}^u \tag{21}$$

$$P_k{}^{uu}(1)=P_{k+1}{}^{uu}(0) \tag{22}$$

$$P_{k-1}{}^u+4P_k{}^u+P_{k+1}{}^u=3(P_{k+1}-P_{k-1}) \tag{23}$$

Where $0 \leqq u \leqq 1$ and k=1,2,3, . . . , n−1,n $P_k{}^u$ is the tangent at the kth point (1st derivative of the position vector with respect to 'u'

$P_k{}^{uu}$ is the second derivative of the position vector with respect to 'u'

If the initial and the final tangent conditions are unknown, two equations need to be found to derive a determinant matrix. Two natural boundary conditions commonly used in CAD/CAM applications are given below.

$$P_0{}^u+0.5P_1{}^u=1.5(P_2-P_1) \tag{24}$$

$$P_{n-1}{}^u+2P_n{}^u=3(P_n-P_{n-1}) \tag{25}$$

Considering the equations 23, 24 and 25, the following matrix relationship can be derived.

$$\begin{bmatrix} 1 & 0.5 & 0 & 0 & \dots & \dots & 0 & 0 & 0 & 0 \\ 1 & 4 & 1 & 0 & \dots & \dots & \dots & \dots & 0 & 0 \\ 0 & 1 & 4 & 1 & 0 & \dots & \dots & \dots & 0 & 0 \\ 0 & 0 & 1 & 4 & 1 & 0 & \dots & \dots & 0 & 0 \\ \vdots & \vdots & \vdots & \vdots & \vdots & \vdots & \vdots & \vdots & \vdots & \vdots \\ \dots & \dots & \dots & \dots & \dots & \dots & \dots & 1 & 4 & 1 \\ 0 & 0 & 0 & 0 & \dots & \dots & \dots & 0 & 2 & 4 \end{bmatrix} \times \begin{bmatrix} P'_1 \\ P'_2 \\ P'_3 \\ P'_4 \\ \vdots \\ P'_{n-2} \\ P'_{n-1} \\ P'_n \end{bmatrix} = \begin{bmatrix} 1.5(P_2-P_1) \\ 3(P_3-P_1) \\ 3(P_4-P_2) \\ 3(P_5-P_3) \\ \vdots \\ 3(P_{n-2}-P_{n-4}) \\ 3(P_{n-1}-P_{n-3}) \\ 6(P_n-P_{n-1}) \end{bmatrix} \tag{26}$$

By solving the above matrix and inducing the derived tangent values for the coordinate points to the equation 14, the Hermite cubic polynomials could be found.

The data that are received from the scanner define the leg and foot surface definition in 3D Cartesian coordinates. A typical leg image may have 600,000 three-dimensional data points or more.

Explanation of the mathematical procedure developed to design and engineer the compression stocking is given with relation to this data cloud. Initial data selection is done by defining the upper limit and the lower limit for the leg data cloud and the upper limit of the foot data cloud. Foot data starting from the upper limit of the foot (which is the same as the lower limit of the leg) is used for designing the foot of the compression stocking. The rest of the stray data are removed from the data clouds.

To define a new central axis for the data cloud of the leg the following mathematical procedure was followed. For the mathematical procedure, the 'Z' axis is along the length of the leg. Data cloud is represented by 'n' Cartesian coordinates.

Let $A=[x_1, y_1, z_1]$ for l=1, 2, 3 . . . n be the raw Cartesian data points which describes the leg surface. Let 'n' be an even number in a system where the origin is 'O'.

Let $A_1=[x_1, y_1, z_1]$ for l=1, 2, 3, . . . n/2 describe the first half of the dataset and $A_2=[x_1, y_1, z_1]$ for l=(n/2)+1, . . . n be the second half of the data set the mean of these two sets are given by $$\overline{OA_1} = \left[\frac{\sum_{1}^{n/2} x_l}{n/2}, \frac{\sum_{1}^{n/2} y_l}{n/2}, \frac{\sum_{1}^{n/2} z_l}{n/2}\right] \text{ and } \quad (27 \& 28)$$

$$\overline{OA_2} = \left[\frac{\sum_{(n/2)+1}^{n} x_l}{n/2}, \frac{\sum_{(n/2)+1}^{n} y_l}{n/2}, \frac{\sum_{(n/2)+1}^{n} z_l}{n/2}\right]$$

then the vector $\overline{A_1A_2}$ is the axis of the data cloud

Let i,j,k be unit vectors in the x,y,z directions of a Cartesian coordinate system with the origin 'O' and let $\overline{A_1A_2}$ be represented in i,j,k.

$$\overline{A_1A_2} = \left(\frac{\sum_{(n/2)+1}^{n} x_l}{n/2} - \frac{\sum_{1}^{n/2} x_l}{n/2}\right)i + \left(\frac{\sum_{(n/2)+1}^{n} y_l}{n/2} - \frac{\sum_{1}^{n/2} y_l}{n/2}\right)j + \left(\frac{\sum_{(n/2)+1}^{n} z_l}{n/2} - \frac{\sum_{1}^{n/2} z_l}{n/2}\right)k \quad (29)$$

$$\text{let } X_{A1A2} = \left(\frac{\sum_{(n/2)+1}^{n} x_l}{n/2} - \frac{\sum_{1}^{n/2} x_l}{n/2}\right) \quad Z_{A1A2} = \left(\frac{\sum_{(n/2)+1}^{n} y_l}{n/2} - \frac{\sum_{1}^{n/2} y_l}{n/2}\right) \quad Y_{A1A2} = \left(\frac{\sum_{(n/2)+1}^{n} z_l}{n/2} - \frac{\sum_{1}^{n/2} z_l}{n/2}\right) \quad (30)$$

To reposition this axis so that it lies parallel to the z axis, the modification is done as follows. First $A_1A_2$ is represented in spherical coordinate format i.e.

$\overline{A_1A_2}=r(\cos\theta\cos\alpha.\underline{i}+\cos\theta\sin\alpha.\underline{j}+\sin\theta.\underline{k})$ where 'θ' is the elevation Since the vector $A_1A_2$ is determinable numerically it is possible to find the value 'θ'.

$$r=\sqrt{X_{A1A2}^2+Y_{A1A2}^2+Z_{A1A2}^2} \quad (31)$$

$$\theta = \sin^{-}\left(\frac{Z_{A1A2}}{r}\right) \quad (32)$$

-continued $$\alpha = \tan^{-}\frac{Y_{A1A2}}{X_{A1A2}} \quad (33)$$

Similarly all the points in the point cloud is converted to spherical coordinates. To make the axis of the point cloud defined above parallel with the 'z' axis, an angle (90-θ) is added to all the θ of all points in the spherical coordinates in the point cloud.

To view the points in the point cloud in 3D Cartesian coordinates, the points are reconverted back into Cartesian coordinates. These points are given by $$(x_{lm}, y_{lm}, z_{lm})$$

This process causes the axis $A_1A_2$ to become parallel with the Z axis and also to rotate all the points in the point cloud. To translate the point cloud so that the axis $A_1A_2$ coincides with the Z axis, the new mean point in the dataset is recalculated $$= \left[\frac{\sum_{1}^{n} x_{lm}}{n}, \frac{\sum_{1}^{n} y_{lm}}{n}, \frac{\sum_{1}^{n} z_{lm}}{n}\right] \quad (34)$$

The translated coordinates are calculated by the relationship $$\left(x_{lm1} - \frac{\sum_{1}^{n} x_{lm1}}{n}, y_{lm1} - \frac{\sum_{1}^{n} y_{lm1}}{n}, z_{lm1}\right) \quad (35)$$

New coordinates $$(x_{lm1}, y_{lm1}, z_{lm1}) \equiv \left(x_{lm} - \frac{\sum_{1}^{n} x_{lm}}{n}, y_{lm} - \frac{\sum_{1}^{n} y_{lm}}{n}, z_{lm}\right) \quad (36)$$

To define the lower selection working height of the leg for the stocking, all of the data points above and below the upper level and the lower level are removed.

The large amount of data used for the calculation causes the processing of it to demand high computing power and time. In the present, non-limiting, example, data originate from four separate point clouds. Hence there are some overlapping data that could complicate the surface definition process. Selection of points for the yarn path from out of this data is considered a better and a faster way of solving this problem. However, particularly in view of the ever increasing computing power associated with commercially available computers, this solution should not be considered to be a limiting one. In the present example, a structure defined by a set of equally spaced longitudinal surface boundary lines is defined on the surface of the leg scan. To ensure a good accuracy level for the reduced data set and to prevent overburdening of the processing stage, an angular pitch of 15° between the surface boundary lines is considered to be appropriate, although other pitches might be employed. To carry out this step the further mathematical activities are performed.

Next the dataset is converted in to polar coordinates. For this the following algorithm is used.

| if | if | if | if | (37) |
|---|---|---|---|---|
| $x_{lm1} \geq 0,\ y_{lm1} \geq 0$ | $x_{lm1} < 0,\ y_{lm1} > 0$ | $x_{lm1} < 0,\ y_{lm1} < 0$ | $x_{lm1} \geq 0,\ y_{lm1} \leq 0$ | |
| then | then | then | then | |
| $\theta_{lm1} = \left(\tan^{-}\frac{\lvert y_{lm1}\rvert}{\lvert x_{lm1}\rvert}\right) \times \frac{180}{\pi}$ | $\theta_{lm1} = \left(\pi - \tan^{-}\frac{\lvert y_{lm1}\rvert}{\lvert x_{lm1}\rvert}\right) \times \frac{180}{\pi}$ | $\theta_{lm1} = \left(\pi + \tan^{-}\frac{\lvert y_{lm1}\rvert}{\lvert x_{lm1}\rvert}\right) \times \frac{180}{\pi}$ | $\theta_{lm1} = \left(2\pi - \tan^{-}\frac{\lvert y_{lm1}\rvert}{\lvert x_{lm1}\rvert}\right) \times \frac{180}{\pi}$ | |
| $r_{lm1} = \sqrt{\lvert x_{lm1}\rvert^2 + \lvert y_{lm1}\rvert^2}$ | $r_{lm1} = \sqrt{\lvert x_{lm1}\rvert^2 + \lvert y_{lm1}\rvert^2}$ | $r_{lm1} = \sqrt{\lvert x_{lm1}\rvert^2 + \lvert y_{lm1}\rvert^2}$ | $r_{lm1} = \sqrt{\lvert x_{lm1}\rvert^2 + \lvert y_{lm1}\rvert^2}$ | |

where $\theta_{lm1}$ is calculated in degrees.

The polar representation of the modified data set is in the $[\theta_{lm1}, r_{lm1}, Z_{lm1}]$ form.

To define the surface boundary lines, an angular tolerance of ±2° was defined with the same base angle. The resultant (r, z) data set was used to define the surface curves.

For each of the longitudinal surface boundary lines selected a smoothing curve is modelled using Least square theory of a suitable power. It was found that for all the scan data related to 15 scans captured from the leg scanner, an order of 5 was sufficient for the Least square polynomials.

For each of the 24 data sets, A Least Squares curve (r vs z) is interpolated For each of the longitudinal surface boundary lines, the initial polar coordinates are given by the following algorithm.

$$\theta_{rib,k} \equiv (15 \times \text{rib})$$

where 'rib' is the longitudinal surface boundary line number given by rib=0, 1, . . . , N k=1, 2, . . . N N=number of points per each longitudinal surface boundary line $r_{rib,k}$=corresponding 'r' values $Z_{rib,k}$=corresponding 'z' values Here angles are measured in degrees Approximating Least Squares function is given by $$r_{rib}(z) = a_0 + a_1 z_{rib} + a_2 z_{rib}^2 + \ldots + a_m z_{rib}^m \tag{38}$$

where $$S_K = \sum_{i=0}^{N} z_i^K$$

$$t_K = \sum_{i=0}^{N} r_i z_i^K$$

where

K=0,1,2, . . . , 2m

Where m=5

N is the number of points in the curve $$\begin{vmatrix} S_0 & S_1 & \cdots & S_K & \cdots & S_{m-1} & S_m \\ S_1 & \cdots & & & & \cdots & S_{m+1} \\ \vdots & & & & & & \\ S_k & & & & & & S_{k+m} \\ \vdots & & & & & & \\ S_m & \cdots & & & & \cdots & S_{2m} \end{vmatrix}_{(m+1)\times(m+1)} \times \begin{vmatrix} a_0 \\ a_1 \\ \vdots \\ a_k \\ \vdots \\ a_m \end{vmatrix}_{(m+1)\times 1} = \begin{vmatrix} t_0 \\ t_1 \\ \vdots \\ t_k \\ \vdots \\ t_m \end{vmatrix}_{(m+1)\times 1} \tag{39}$$

Figure 7:
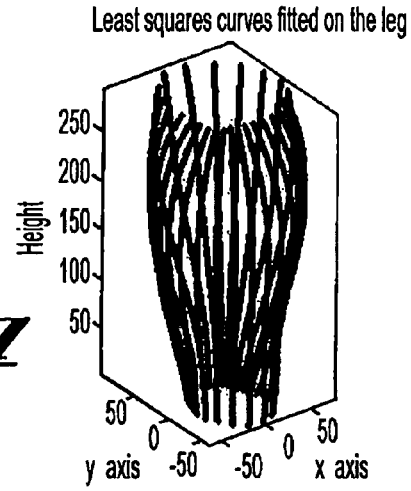
FIG. 7 shows longitudinal surface boundary lines defining a leg surface.

The above matrix is solved to find the coefficients of the least squares function. The resultant longitudinal surface boundary line along the length of the leg, on the leg surface is shown in FIG. 7.

Definition of the pressure profile on a leg due to a particular stretch fabric stocking requires the definition of the fabric on the leg. Since the seamless stocking is generally tubular in shape geometric definition of the stocking is given by the path of the courses in the knitted stocking. Points produced due to the intersection of these courses with the above defined surface boundary lines are determined starting from the lower end of the leg up. This is realised by determining points along the longitudinal surface boundary lines at the course separation distances.

To calculate the points along the least squares function, in each of the vertical section, following equation is solved.

$$(P \times c) = \int_{z_0}^{z} \left( \sqrt{1 + \frac{dr(z)}{dz}} \right) dz \tag{40}$$

where

'P' is the course number, $z_0$ is the lowermost 'z' coordinate and 'c' is the course separation To find out the values applicable for 'P', the length of the anterior longitudinal surface boundary line between the height limits is determined. This is carried out by the sum of values given below.

$$\text{Anterior line curve length} = \Delta z\left(1 + \left(\left(\frac{dr}{dz}\right)_{anterior\ rib}\right)^2\right)^{0.5} \quad (41)$$

where $\Delta z = 0.0001$ mm $$\left(\frac{dr}{dz}\right)_{anterior\ rib}$$

is the gradient of the anterior polynomial curve at each '$\Delta z$' separation The nearest integer given by the division $$N_{course} = \frac{\text{Anterior line curve length}}{c} \quad (42)$$

is used to determine the maximum value for 'P'

Maximum 'P'=$N_{course}$'.

Starting from the anterior longitudinal surface boundary line, for each of the longitudinal surface boundary lines $z_0$ is defined so that it is set above the previous longitudinal surface boundary line's $z_0$ by a course separation distance 'c'. The anterior longitudinal surface boundary line is selected when rib=0.

Starting 'z' values for the rest of the longitudinal surface boundary lines are given by $$z_{rib,1} = z_{lowest} + \left(\frac{2c}{360} \times rib \times 15\right) \quad (43)$$

where $z_{lowest} = z_{0,0}$

The rest of the points are spaced at a distance 'c' along respective interpolated curves from the starting point upwards. This requires that points are found at specified distances along each curve. The last point corresponds to the number of courses in the fabric. Hence, the length of the fabric is an integer multiple of 'c'.

Hence the order of the points for course path generation is given by $$P_{rib,k} \quad (44)$$

where k=1, 2, 3, . . . $N_{course}$ $23 \geqq rib \geqq 0$

The above algorithm is used to generate the points for the elastomeric course path. Data points that are in the polar coordinates are converted to Cartesian coordinates to facilitate the rest of the calculations.

Hence, for $[\theta_k, r_k, z_k]$ where k=1, 2, 3, . . . , n−1, n $$[x_k, y_k, z_k] \equiv [r_k \cos\theta_k, r_k \sin\theta_k, z_k] \quad (45)$$

The arrangement of the points is shown below, Where $[P_{rib,k} \equiv [x_{rib,k}, y_{rib,k}, z_{rib,k}]$ Order of the 3D Cartesian coordinate points are shown by $[P_{0,1}, P_{1,1}, P_{2,1} \ldots P_{22,1}, P_{23,1},$ $P_{0,2}, P_{1,2}, P_{2,2}, \ldots P_{22,2}, P_{23,2},$

. . . ,

. . . , $P_{0,(N_{course}-1)}, P_{1,(N_{course}-1)}, P_{2,(N_{course}-1)}, \ldots P_{22,(N_{course}-1)}, P_{23,(N_{course}-1)},$ $P_{0,N_{course}}, P_{1,N_{course}}, P_{2,N_{course}}, \ldots P_{21,N_{course}}, P_{22,N_{course}}, P_{23,N_{course}}]$ It is possible that when the course path is defined along the points given in the above order, the path may have concave regions. In reality, in such places the fabric would wrap tangentially providing a flat region with infinite radius of curvature. By having a radius of curvature which is negative or infinite, no pressure would be applied on the leg surface, and thus a modification is performed to make the fabric path flatter at such places.

In order to make this modification, the above points in the Cartesian coordinates are converted to polar coordinates by using the conversion in equation 37

$$[\theta_{kp}, r_{kp}, z_{kp}]$$

where kp=1, 2, 3, . . . n−1, n a polynomial function is defined for the set of coordinate set $r_{kp}$ vs $\theta_{kp}$ where kp=1, 2, 3, . . . n−1, n wherever $$\frac{d^2 r_{kp}}{d\theta_{kp}^2} < 0$$

the $[\theta_{kp}, r_{kp}]$ coordinate at that point is missed and a new polynomial is defined. From this polynomial, the modified $r_{kp}$ is found for the angle $\theta_{kp}$. From this a modified set of $[\theta_{kp}, r_{kp}, z_{kp}]$ is found where kp=1, 2, 3, . . . , n−1, n This ensures that the negative curvature areas are accounted for in defining the pressure profile.

Before use in the equations presented below, the modified data set is converted into Cartesian coordinates.

Let the modified data set be represented by $[\theta_{kp}, r_{kp}, z_{kp}]$ where kp=1, 2, 3, . . . , n−1,n $$x_{kp} = r_{kp} \operatorname{Cos}(\theta_{kp})$$

Then $$x_{kp} = r_{kp} \operatorname{Sin}(\theta_{kp})$$

where kp=1, 2, 3, . . . n−1, n

Hence the modified Cartesian point set is given by $$[x_{kp}, y_{kp}, z_{kp}]$$

where kp=1, 2, 3, . . . , n−1, n

Let the data points selected in the elastomeric yarn path be represented by $$P_{yp} = [x_{yp}, y_{yp}, z_{yp}] \text{ for } yp = 1, 2, \ldots, n-1, n \quad (46)$$

The 3D space curve joining these points is modelled by a piecewise cubic parametric curve which has the 1st and 2nd order continuity. Parametric curve is normalised between (0,1).

Hence the yarn path is given by the equations $$P_{yp}(u)=(2u^3-3u^2+1)P_{yp-1}+(-2u^3+3u^2)P_{yp}+(u^3-2u^2+u)P_{yp-1}{}^{u}+(u^3-u^2)P_{yp}{}^{u} \quad (47)$$

$$P_{yp+1}(u)=(2u^3-3u^2+1)P_{yp}+(-2u^3+3u^2)P_{yp+1}+(u^3-2u^2+u)P_{yp}{}^{u}+(u^3-u^2)P_{yp+1}{}^{u} \quad (48)$$

$$P_{yp}{}^{uu}(u)=(12u-6)P_{yp-1}+(-12u+6)P_{yp}+(6u-4)P_{yp-1}{}^{u}+(6u-2)P_{yp}{}^{u} \quad (49)$$

$$P_{yp+1}{}^{uu}(u)=(12u-6)P_{yp}+(-12u+6)P_{yp+1}+(6u-4)P_{yp}{}^{u}+(6u-2)P_{yp+1}{}^{u} \quad (50)$$

$$P_{yp}{}^{uu}(1)=P_{yp+1}{}^{uu}(0) \quad (51)$$

$$P_{yp-1}{}^{u}+4P_{yp}{}^{u}+P_{yp+1}{}^{u}=3(P_{yp+1}-P_{yp-1}) \quad (52)$$

Where $0 \leqq u \leqq 1$ $P_{yp}{}^{u}$ is the tangent at the $_{yp}$ th point (1st derivative of the position vector with respect to 'u'

$P_{yp}{}^{uu}$ is the second derivative of the position vector with respect to 'u'

$$P_0{}^{u}+0.5P_1{}^{u}=1.5(P_2-P_1) \quad (53)$$

$$P_{n-1}{}^{u}+2P_n{}^{u}=3(P_n-P_{n-1}) \quad (54)$$

are considered to represent the natural end conditions. Equation 51 is solved to find $P_{yp}{}^{u}$ and these values are used to get the space curve in the 'u' parametric variable. As shown in equation 26, the relationship between the equations 46 to 53 can be resolved in to the following matrix format.

$$\begin{bmatrix} 1 & 0.5 & 0 & 0 & \dots & \dots & 0 & 0 & 0 & 0 \\ 1 & 4 & 1 & 0 & \dots & \dots & \dots & \dots & 0 & 0 \\ 0 & 1 & 4 & 1 & 0 & \dots & \dots & \dots & 0 & 0 \\ 0 & 0 & 1 & 4 & 1 & 0 & \dots & \dots & 0 & 0 \\ \vdots & \vdots & \vdots & \vdots & \vdots & \vdots & \vdots & \vdots & \vdots & \vdots \\ \dots & \dots & \dots & \dots & \dots & \dots & \dots & 1 & 4 & 1 \\ 0 & 0 & 0 & 0 & \dots & \dots & \dots & 0 & 2 & 4 \end{bmatrix} \times \begin{bmatrix} P_1^u \\ P_2^u \\ P_3^u \\ P_4^u \\ \vdots \\ P_{n-2}^u \\ P_{n-1}^u \\ P_n^u \end{bmatrix} = \begin{bmatrix} 1.5(P_2-P_1) \\ 3(P_3-P_1) \\ 3(P_4-P_2) \\ 3(P_5-P_3) \\ \vdots \\ 3(P_{n-2}-P_{n-4}) \\ 3(P_{n-1}-P_{n-3}) \\ 6(P_n-P_{n-1}) \end{bmatrix} \quad (55)$$

By taking the inverse of both sides, it can be expressed as $$\begin{bmatrix} P_1^u \\ P_2^u \\ P_3^u \\ P_4^u \\ \vdots \\ P_{n-2}^u \\ P_{n-1}^u \\ P_n^u \end{bmatrix} = \begin{bmatrix} 1 & 0.5 & 0 & 0 & \dots & \dots & 0 & 0 & 0 & 0 \\ 1 & 4 & 1 & 0 & \dots & \dots & \dots & \dots & 0 & 0 \\ 0 & 1 & 4 & 1 & 0 & \dots & \dots & \dots & 0 & 0 \\ 0 & 0 & 1 & 4 & 1 & 0 & \dots & \dots & 0 & 0 \\ \vdots & \vdots & \vdots & \vdots & \vdots & \vdots & \vdots & \vdots & \vdots & \vdots \\ \dots & \dots & \dots & \dots & \dots & \dots & \dots & 1 & 4 & 1 \\ 0 & 0 & 0 & 0 & \dots & \dots & \dots & 0 & 2 & 4 \end{bmatrix}^{-1} \times \begin{bmatrix} 1.5(P_2-P_1) \\ 3(P_3-P_1) \\ 3(P_4-P_2) \\ 3(P_5-P_3) \\ \vdots \\ 3(P_{n-2}-P_{n-4}) \\ 3(P_{n-1}-P_{n-3}) \\ 6(P_n-P_{n-1}) \end{bmatrix} \quad (56)$$

By using the resultant $P_{yp}{}^{u}$ for yp=1, 2, . . . , n −1, n $P_{yp}(u)$ can be found out.

Under these conditions it could be approximated that the lengthwise tension in the socking is negligible. Hence for the development of the present mathematical models, it is assumed that there are no transverse stresses for the fabric course. Also to simplify the calculation process, a single curvature value along the course path is considered.

Figure 8:
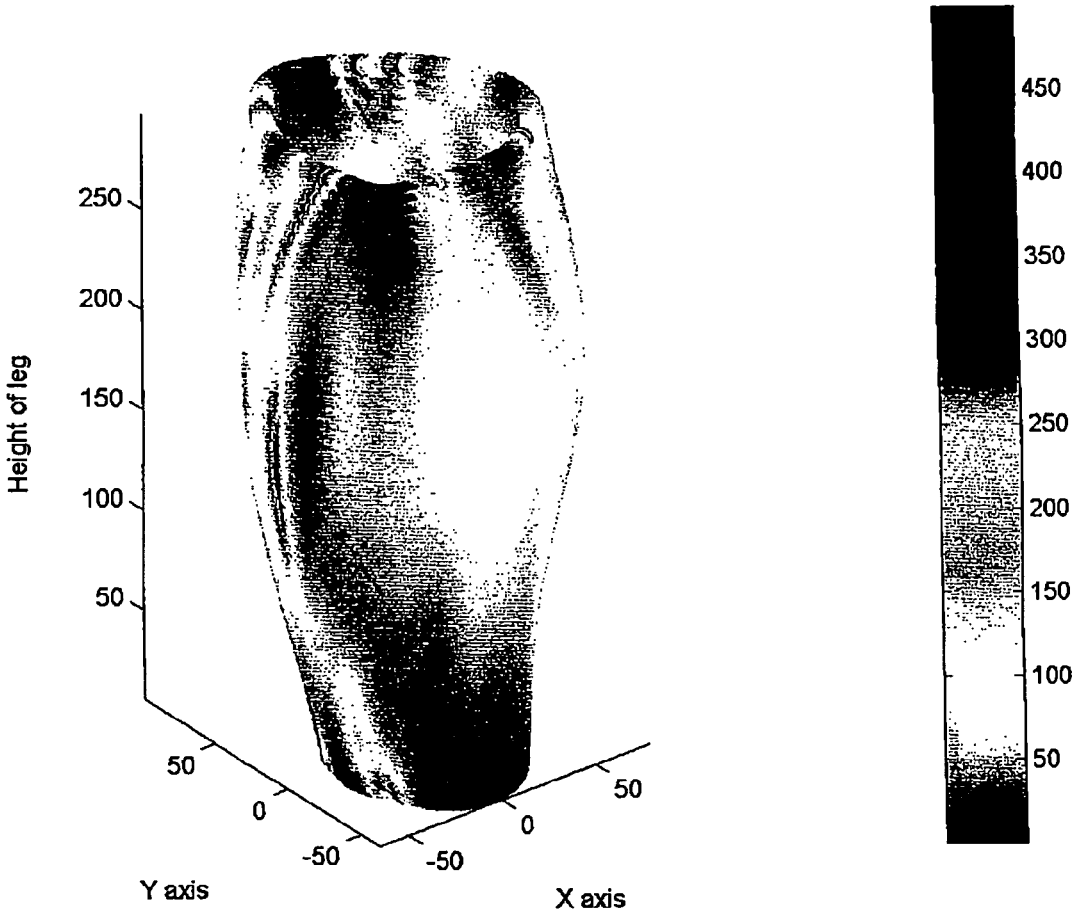
FIG. 8 shows a radius of curvature profile for a pressure stocking.

The radius of curvature profile calculated by this calculation is shown in FIG. 8.

In the design of the stocking, the boundary requirements of the compression stockings are that, when on the leg, the lengthwise tension in the top boundary and the lower limit of the leg should be zero. When these conditions are satisfied, the stocking should stay in the located position without foot movement pulling it down.

Since the position vectors at the angles 0 and 2π are known, one helical revolution equals the total length of front and back bed course. Thus, length for each helical revolution is calculated using the "Gaussian quadrature". Hence, if there are 'N' spline pieces in a revolution describing the elastomeric course path, using four weights and abscissas per each spline piece revolution lengths $$\sum_{i=1}^{N} \frac{1}{2} \left\{ \begin{array}{l} 0.34785484+\sqrt{\left[x_i^u\left(\frac{1.86113631}{2}\right)\right]^2+\left[y_i^u\left(\frac{1.86113631}{2}\right)\right]^2+\left[z_i^u\left(\frac{1.86113631}{2}\right)\right]^2}+ \\ 0.65214515+\sqrt{\left[x_i^u\left(\frac{1.33998104}{2}\right)\right]^2+\left[y_i^u\left(\frac{1.33998104}{2}\right)\right]^2+\left[z_i^u\left(\frac{1.33998104}{2}\right)\right]^2}+ \\ 0.65214515+\sqrt{\left[x_i^u\left(\frac{0.66001895}{2}\right)\right]^2+\left[y_i^u\left(\frac{0.66001895}{2}\right)\right]^2+\left[z_i^u\left(\frac{0.66001895}{2}\right)\right]^2}+ \\ 0.34785484+\sqrt{\left[x_i^u\left(\frac{0.13886368}{2}\right)\right]^2+\left[y_i^u\left(\frac{0.13886368}{2}\right)\right]^2+\left[z_i^u\left(\frac{0.13886368}{2}\right)\right]^2} \end{array} \right\} \quad (57)$$

-continued where, $x_i^u(u)$, $y_i^u(u)$, $z_i^u(u)$ is given by $$[x_i^u(u),\ y_i^u(u),\ z_i^u(u)] \equiv \begin{bmatrix} (6u^2-6u)x_{i-1}+(-6u^2+6u)x_i+(3u^2-4u+1)x_{i-1}^u+(3u^2-2u)x_i^u, \\ (6u^2-6u)y_{i-1}+(-6u^2+6u)y_i+(3u^2-4u+1)y_{i-1}^u+(3u^2-2u)y_i^u, \\ (6u^2-6u)z_{i-1}+(-6u^2+6u)z_i+(3u^2-4u+1)z_{i-1}^u+(3u^2-2u)z_i^u \end{bmatrix}$$

A pressure calculation model is used to decide the pressure profile on the leg surface. In one embodiment, an empirical model is described for each of the material variable. In defining a pressure for the marked cross sections on the leg, points where the pressure applied to the leg are defined are selected for the lower selected cross section, middle cross section and the upper selected cross section. On the selection of these points, a radius of curvature associated with each of these points can be calculated. It is possible to define a greater number of points where the pressure applied to the leg are defined.

Let the pressure definition points on the three selected cross sections be $Pt_1$, $Pt_2$ and $Pt_3$. The associated radius of curvatures at these points are given by the general equation $$\rho(u)_{yp} = \frac{1}{\dfrac{|P_{yp}^u(u) \times P_{yp}^{uu}(u)|}{|P_{yp}^u(u)|^3}} \tag{58}$$

Since the Pressures required at these points are known and the radius of curvatures are known, from the material empirical model the relevant strain is determined.

Let the strains at the above three points be $S_{pt_1}$, $S_{pt_2}$ and $S_{Pt_3}$, and the revolution lengths be revolution lengths $_{Pt_1}$, revolution lengths $_{Pt_2}$ and revolution length $_{Pt_3}$ Then the course lengths in the stocking are equal to $$\frac{revolution\ length_{Pt_1}}{(1+S_{Pt_1})}, \tag{59}$$

$$\frac{revolution\ length_{Pt_2}}{(1+S_{Pt_2})} \text{ and} \tag{60}$$

$$\frac{revolution\ length_{Pt_3}}{(1+S_{Pt_3})} \tag{61}$$

Since the wale density of the fabric is known, the number of stitches in each course is found as follows $$\text{number of stitches in course}_{Pt_1} = \frac{\left(\dfrac{revolution\ length_{Pt_1}}{2}\right)}{w}, \tag{62}$$

$$\text{number of stitches in course}_{Pt_2} = \frac{\left(\dfrac{revolution\ length_{Pt_2}}{2}\right)}{w} \tag{63}$$

and

-continued $$\text{number of stitches in course}_{Pt_3} = \frac{\left(\dfrac{revolution\ length_{Pt_3}}{2}\right)}{w} \tag{64}$$

where 'w' is the wale separation

Let the lower selected cross section pressure be pressure $_{ankle}$, the midway pressure definition be pressure$_{midways}$, maximal calf cross section pressure definition be pressure$_{maximal}$ and the top course pressure definition be pressured$_{top}$ Let the number of courses in the stocking between the lower selected cross section and the middle cross section be $N_1$, the number of courses between the middle course and the maximal calf cross section be $N_2$ and the number of courses between the maximal calf cross section to the top stocking course be $N_3$ The pressure gradient calculation for each course in the respective region is as follows. $0 \leqq$ course number $\leqq N_1$ $$0 \le \text{course number} \le N_1$$

$$\text{pressure(course number)} = pressure_{ankle} - \frac{(pressure_{ankle} - pressure_{midway})}{N_1} \tag{65}$$

$$N_1 + 1 \le \text{course number} \le N_2$$

$$\text{pressure(course number)} = pressure_{midway} - \frac{(pressure_{midway} - pressure_{maximal})}{N_2} \tag{66}$$

$$N_2 + 1 \le \text{course number} \le N_3$$

$$\text{pressure(course number)} = pressure_{maximal} - \frac{(pressure_{maximal} - pressure_{top})}{N_3} \tag{67}$$

Figure 9:
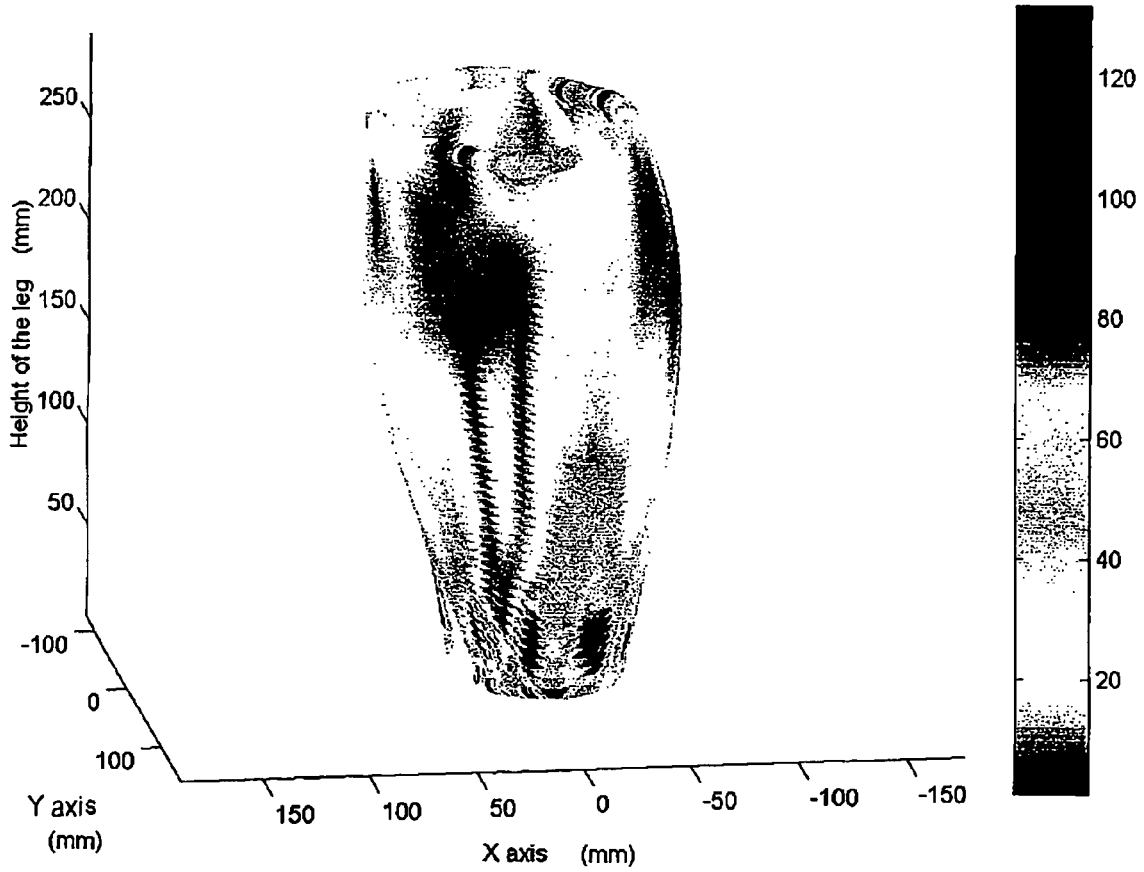
FIG. 9 shows a pressure profile for a pressure stocking.

Since the pressure gradient is applied along a longitudinal surface boundary line in the anterior side of the leg, point definitions and the radius of curvature definitions of each point on the longitudinal surface boundary line are known. Thus, the strain and hence the course lengths of the stocking can be determined. The pressure profile calculated through this process is shown below in FIG. 9.

The pressure incident on the leg is due to the stretch in the stocking fabric when it is worn on the leg. By controlling the strain in each of the courses, tension in the particular course is controlled so that at the selected radius of curvature the defined pressure is applied. The present invention provides for control of the strain (and hence control of the tension) by variation of the number of needles knitted in each course.

Since in the present example the leg scanner is not able to capture the foot and the leg at the same time, leg and foot scans are taken at two different instances and each need to be realigned and repositioned separately. If the leg and foot scans were accomplished in one scan, a process which is within the scope of the invention, only a single initial data processing and realignment stage would be required.

The foot scan is taken whilst the subject is sitting down and keeping the leg horizontal. Hence the orientation of the scan is not as in the in the case of standing. Data above the selection cross section are removed.

Data points are received in Cartesian coordinates and colour reference data. Let these coordinates be represented by $[x_{ii}, y_{ii}, z_{ii}]$ where ii=1, 2, 3, 4, . . .

To facilitate the reorientation of the foot to bring it near to its natural horizontal orientation a vector is defined inside the point cloud of the foot. In order to achieve this, two points in the foot point cloud are selected.

Let '$y_{jj}$' be the maximum 'y' coordinate in the foot point cloud and the point definition of this point be $[x_{jj}, y_{jj}, z_{jj}]$. Let '$y_{kk}$' be the minimum 'y' coordinate in the foot point cloud and point definition of this point be $[X_{kk}, y_{kk}, z_{kk}]$.

The vector given by joining these two points is $$(x_{jj}-x_{kk})i+(y_{jj}-y_{kk})j+(z_{jj}-z_{kk})k$$

Where i, j, k are unit vectors in the x, y, z directions. This vector is converted to spherical coordinates to find out the azimuth and the elevation of the vector is as follows.

$$(x_{jj}-x_{kk})i+(y_{jj}-y_{kk})j+(z_{jj}-z_{kk})k \equiv r(\cos\theta\cos\alpha.\underline{i}+\cos\theta\sin\alpha.\underline{j}+\sin\theta.\underline{k})$$

where θ is the elevation and α is the azimuth.

$$r=\sqrt{(x_{jj}-x_{kk})^2+(y_{jj}-y_{kk})^2+(z_{jj}-z_{kk})^2}$$

$$\theta=\sin^{-}\left(\frac{(z_{jj}-z_{kk})}{r}\right)$$

$$\alpha=\tan^{-}\frac{(y_{jj}-y_{kk})}{(x_{jj}-x_{kk})}$$

using the same conversion all the points in the foot data cloud is represented in spherical coordinates.

These coordinates are expressed in the format of $[\alpha_{ii}, \theta_{ii}, r_{ii}]$ where ii=1, 2, 3, 4.

To re-orientate the point cloud, the point cloud is modified as follows $$[(\alpha_{ii}-\alpha),(\theta_{ii}-\theta),r_{ii}]$$

where ii=1, 2, 3, 4, . . .

These spherical coordinates when converted back to Cartesian coordinates is in the form of $[x_h, y_h, z_h]$ where h =1, 2, 3, . . .

In designing the foot part of the stocking, the usual (but non-limiting) practice is to refrain from a pressure definition analysis. Rather, the foot part of stocking is produced with approximately the same strain percentage in each fabric course. To tailor the foot part of the stocking certain measurements are required from the scan.

The capture of the measurements requires the capture of cross sectional circumferences and the length dimensions along the foot. This information is achieved through selecting points on the scan and then taking measurements from the cross sections associated with these selected points.

Figure 10:
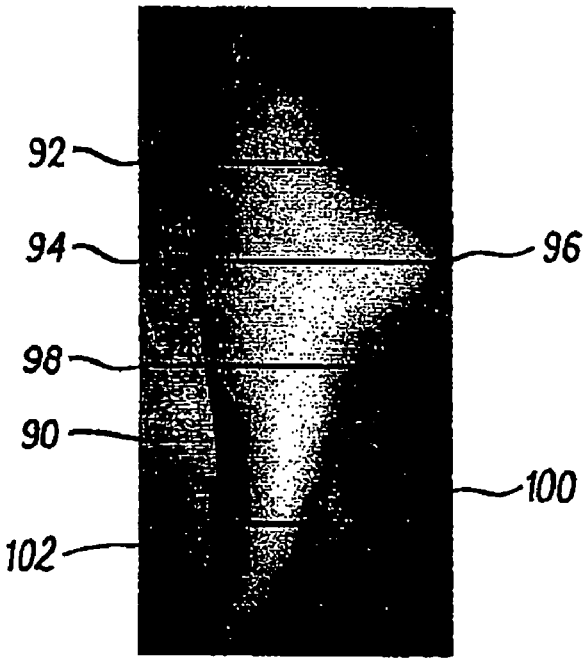
FIG. 10 shows the selection of cross-sectional cuts on a scanned image of a foot.

The point selection is as shown in FIG. 10, which shows a scan of a foot 90 depicting selected points 92, 94, 96, 98, 100 and 102. In the scans described, the 'x axis' is in the horizontal direction towards the right, 'y axis' in the vertical direction upward and the 'z axis' is out of the plane of the paper. As shown in FIG. 10, by defining a polynomial curve across the points 92, 94, 96, 98, 100 and 102, the length of the foot part of the stocking is determined. The plane across the points 94 and 96 going in the 'z' direction gives the circumferential length of the heel diagonal cross section of the foot. The cross sectional circumference across the points 98 and 100 gives the circumferential dimensions at the bridge of the foot and at the base of the big toe.

The Least Squares method may be used to determine the curve lengths associated with the points 92, 94, 96, 98, 100 and 102. On the determination of the polynomial function passing through the points 92, 94, 96, 98, 100 and 102, the associated curve lengths are determined using equation 41.

Assuming the coordinates at the points 94 and 96 are given by $(x_2, y_2, z_2)$ and $(x_3, y_3, z_3)$, the line 94 to 96 is given by the vector $(x_3-x_2)i+(y_3-y_2)j+(z_3-z_2)\underline{k}$. Since these two points are in the same plane the $z_3-z_2$ component vanishes and is not considered. The gradient of the line is given by '$\theta_{23}$', where $$\theta_{23}=\tan^{-}\left(\frac{y_3-y_2}{x_3-x_2}\right)$$

To select the cross section given on the plane going through the points 94 and 96 and parallel to the 'z' axis, first all of the points in the foot scan need to be rotated by an angle equal to $\theta_{23}$. For this the following modification is performed on the foot point cloud.

Let the points on the realigned point cloud be $[x_h, y_h, z_h]$ where h=1, 2, 3, . . .

Then to rotate the point cloud by '$\theta_{23}$', first the point cloud is represented in polar coordinates. The algorithm for the conversion is the same as equation 37. The resulting polar coordinates are represented by, $[\theta_h, r_h, z_h]$ form. where h=1, 2, 3, . . .

The rotation of the realigned foot point cloud is achieved by the following modification.

$$\left[\theta_h+\frac{\pi}{2}-\theta_{23}, r_h, z_h\right]$$

where h=1, 2, 3, . . .

Of these data points all the data points in the subset $$-\frac{\pi}{180}\le\theta_h+\frac{\pi}{2}-\theta_{23}\le\frac{\pi}{180}$$

were selected.

The angle of this subset data points were approximated to zero and the circumference of the cross sectional data in the subset was used to determine the circumference of the cross section. In this process, the algorithms described by equations 38 and 39 are used to define twenty four mean points in the 360° region, and then the sum of the point to point distances were taken as the circumference of the foot cross section. Since no pressure definition is given to the foot data and only a low strain is applied on the foot part of the stocking, the accuracy achieved by the above-described method to determine the circumference of the cross section is believed to be sufficient.

The same procedure was adopted in the determination of the cross sections through the 44 and 55 parallel to the z axis.

Figure 11:
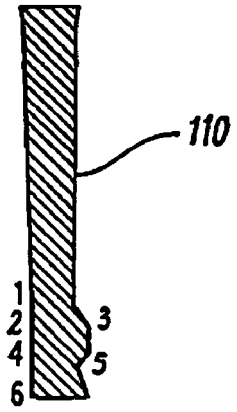
FIG. 11 shows the general shape of a stocking silhouette.

The general shape of the stocking silhouette 110 with the associated point selection is given in FIG. 11.

Figure 12:
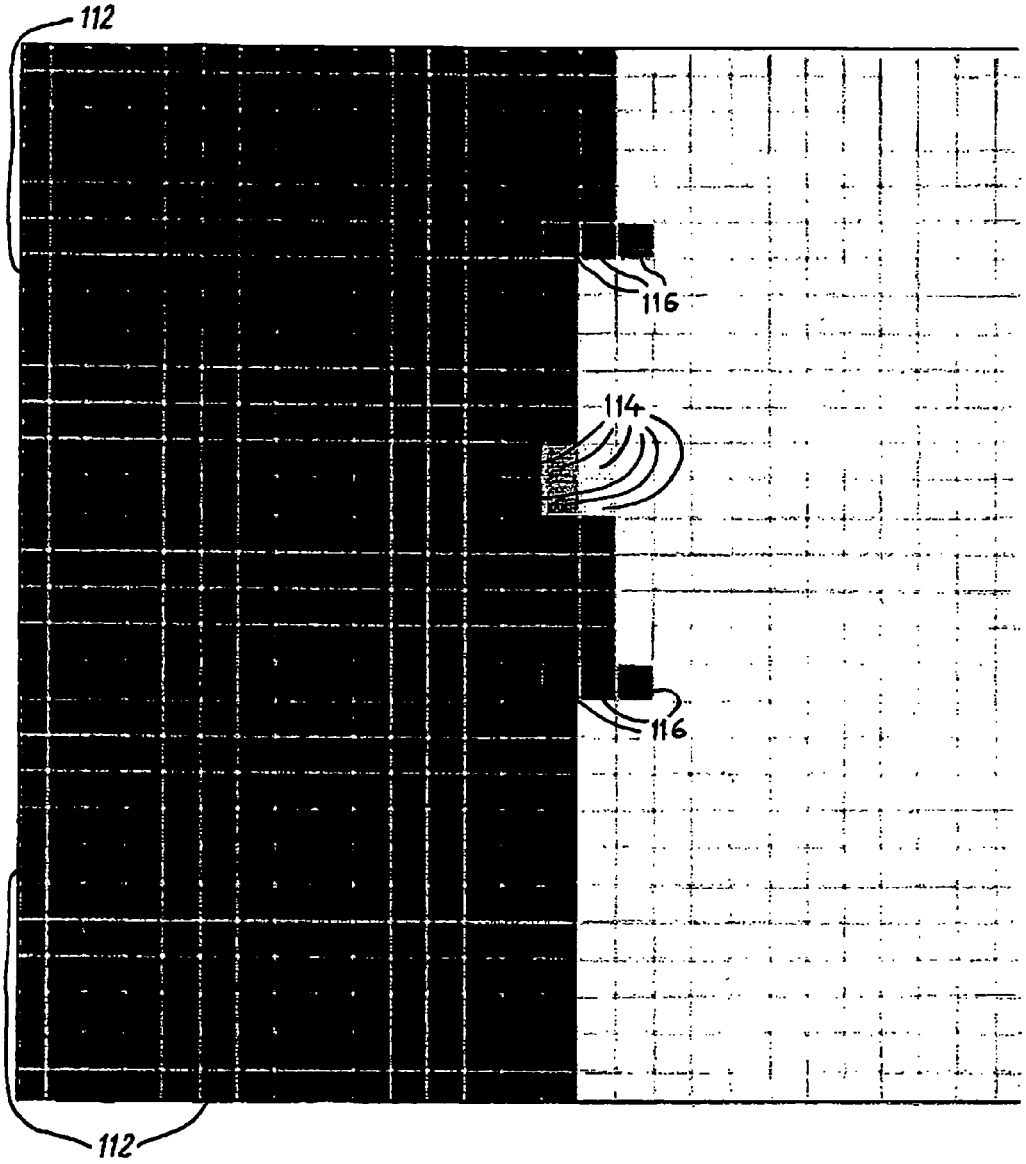
FIG. 12 is an expanded representation of a portion of the silhouette of FIG. 11 showing the pixelated representation of the knitting needles.

The silhouette 110 is formed from a 2D TIF image comprised of black single pixel squares. As shown in FIG. 12, each needle knitted is represented by a single square 112. The total number of squares in the silhouette is equal to half the circumference of the cross section. Hence the silhouette represents the front bed needle diagram for the knitting of the stocking. In a flatbed knitting machine, the garment is made seamless by knitting it as a tube. The shaping according to the silhouette is achieved by increasing and decreasing needles knitted in each course. This silhouette is knitted in a STOLL CMS 18 gauge machine (Stoll CMS E18 electronic flatbed knitting machine, Stoll GmbH & Co, Reutlingen, Germany), which uses the program SIRIX to convert the silhouette in to machine code. This is done by a TIF to Jacquard feature available in the SIRIX. For the machine to identify the shaping points, as required by the SIRIX, six green single pixels 114 are added at each narrowing or three magenta single pixels 116 are added for widening points either side of the silhouette. In a non-limiting example, the widening allowed for the stocking structure may be one needle per each 4 courses. This ensures that there is enough strength in the edges of the stocking. Thus, the number of rows in the silhouette is equal to the number of courses in the stocking, and the number of black squares and their relative position to the other squares in each row is equal to the number of stitches in each of the rows and their position. The skilled reader will appreciate that similar schemes can be employed with other commercially available knitting machines having similar capabilities.

The leg part of the stocking silhouette is designed, using the circumferential lengths captured as described above. These circumferential lengths were modified to account for the strain allowed in each of the courses. The starting circumference of the foot part is equal to the bottom course data of the leg silhouette. From thereon to the point 3 shown in FIG. 11 is calculated at a gradient of 'every 2 courses, one needle increase'. Other gradients might be used, but the slope of the heel should not be so great that the knitting machine used (Stoll CMS E18 electronic flatbed knitting machine in this example) would be unable to knit the design.

The width '23' is equal to the cross sectional circumference through the points2 and 3 shown in FIG. 11, subject to the subsequent needle point reduction of 22%. The length 3 to 5 is equal to $\frac{1}{3}^{rd}$ of the '23 circumference', which is the traditional rule of thumb used in the manufacture of socks. From this point to the '44 cross section' the reduction of the needle points is performed on the basis of 'every 2 courses, one needle increase'.

Figure 13:
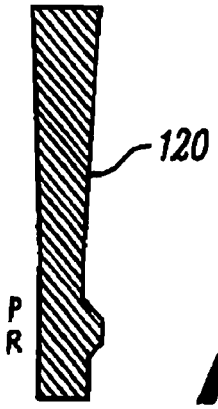
FIG. 13 shows a stocking silhouette depicting an area of structural modification in the region of the foot.

From the '44 cross section' up to the end of the stocking at point 6 in FIG. 11, the graduation is designed from the strain accounted 44 circumference to the strain accounted 55 circumference. The shape of the resulting silhouette 120 is shown in FIG. 13.

The pressure stocking is knitted starting from the foot part, upwards. At the starting end and the finishing end, two rib structures are knitted to hold the stocking on the leg without movement and to prevent unravelling of the knitted fabric. To allow the stocking foot to bend and position on the foot, a triangular patch (PQR) at the point 2 as shown in FIG. 11 is knitted every other row in the silhouette. Point P is at the start of the foot part, Q is at the middle of the 23 cross section, and R is selected so that PQ length is equal to QR and PQR defines an isosceles triangle. This modification is performed in the knitting machine control software. A complete pressure stocking is thus knitted with the features discussed above which are specifically tailored for the wearer of the stocking.

The collection of pressure values at specific radii of curvature will now be described in more detail. Ideally to get the pressure profile applied on the leg by a stretch fabric, one would need to assemble a network of sensor cells on the leg surface and get the feedback to the external visual media without affecting the radius of curvature profile of the leg. The garment pressure due to the extension of the fabric could also be measured by recording the extension itself along with the tension required to produce this extension. One way of performing this is through virtual means. If the empirical pressure performance of the stretch fabric is defined over the range of possible radius of curvatures for different levels of strain, the same could be used to determine the point specific pressures of the leg profile through interpolation of the pressure values over the whole 2D range.

Experimental pressure values at a specific radius of curvature and strain can be obtained by positioning the fabric tube on a cylindrical surface and measuring the pressure exerted by the fabric. When a fabric tube is put on a cylinder with a circumference higher than the circumference of the fabric tube, it has to be stretched. When the fabric is stretched for this, always the fabric experiences higher strain than required. This effect creates the need for the tube to be left for pressure stabilisation. To remove subjective errors caused by this effect, it is advantageous to provide a test rig, which can change from a small radius of curvature to a higher radius of curvature. It is not necessary that such a test rig is able to cover the whole range of radii. Hence a test rig, which would work in part of the effective radii of curvatures, has been produced. Radii of curvature values outside those testable on the rig can be tested through available cylinders.

Figure 14:
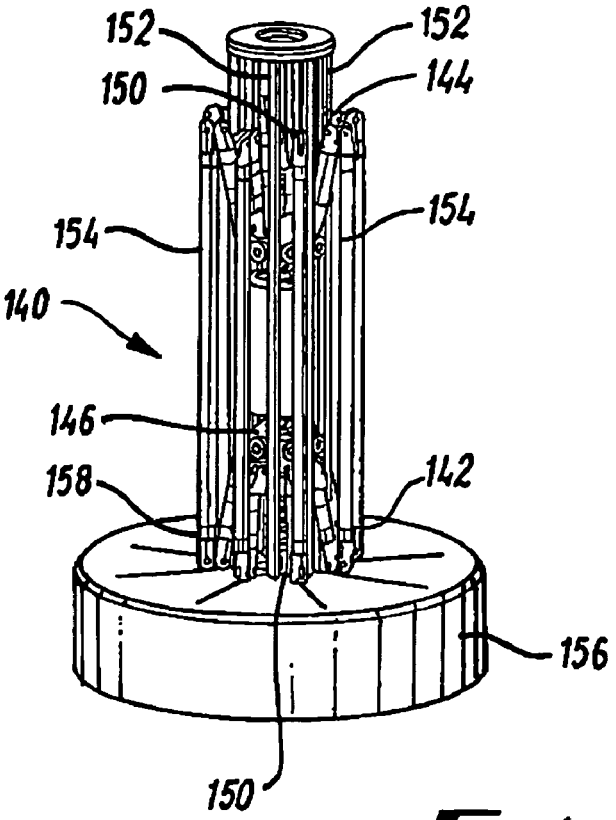
FIG. 14 is a perspective view of a test rig.
Figure 15:
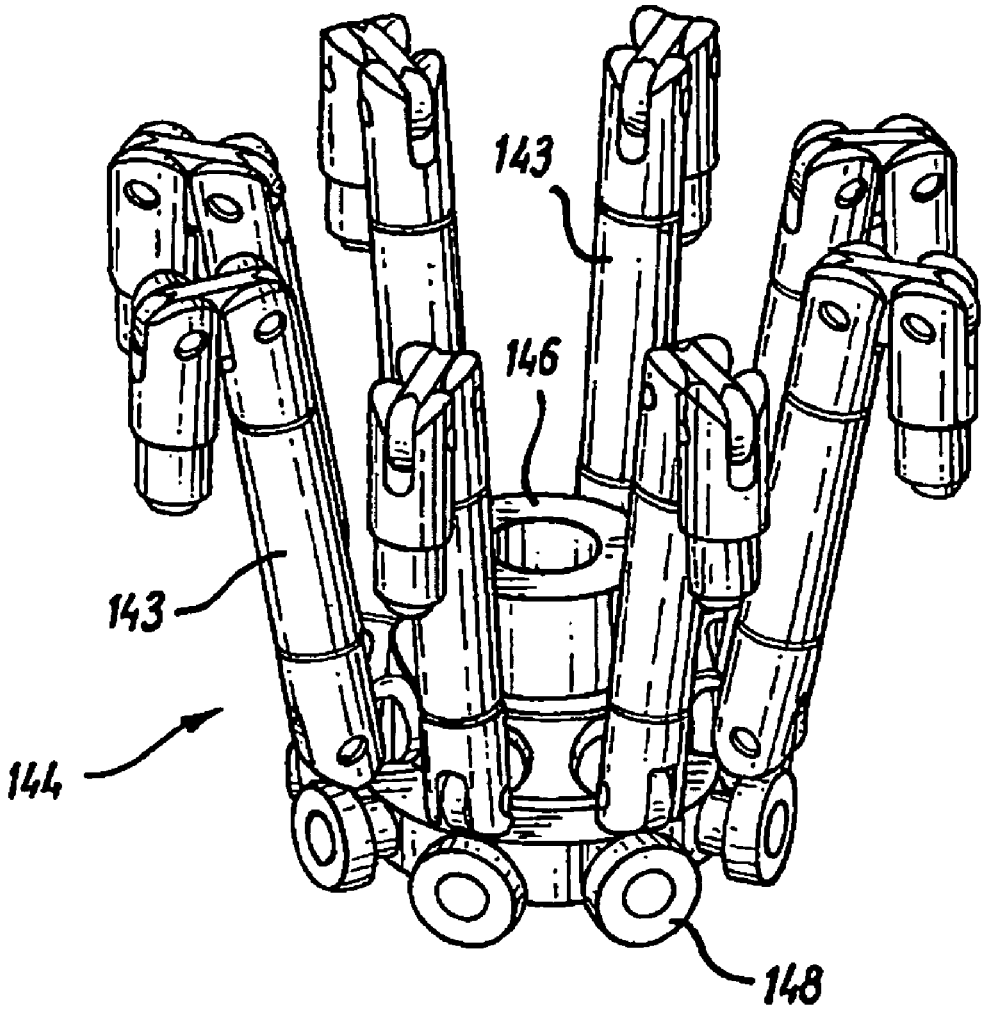
FIG. 15 is a perspective view of an expanding link system.

The main aim of the test rig is to observe the effect of radius of curvature on the pressure under the fabric. A cylinder is provided as the base surface of the test-rig to produce a uniform stress distribution around a curved surface. To collect pressure values at different radius of curvatures, the test rig should have the ability to change the radius of its cylinder. To achieve this, an expanding link system is provided with a flat sheet wrapped around it. The cylindrical surface needs to be mounted with freedom for unravelling and bending while the fabric is on it. This presents a uniform radius of curvature. A test rig 140 suitable for this purpose is shown in FIGS. 14 and 15. The test rig 140 comprises two separately movable expanding linkages 142, 144.Each linkage 142, 144 comprises a plurality of rods, and is connected to a movable member 146 which can be translated upwards and downwards. The links 142, 144 are restricted to move in the radial direction and thus vertical movement of a movable member causes movement of a linkage. Bearings 148 at the base of a movable member prevent its rotation.

To increase the mechanical advantage in the movement of expanding linkage up and down, lead screws 150 are used. To achieve a cylindrical surface, the two expanding linkages 142, 144 are positioned at the two ends of the cylinder. Movement of the two expanding linkages 142, 144 is restricted inside a set of circularly placed metal rods 152. Hollow steel tubes 154 link the two expanding linkages 142, 144 together. All of these elements are mounted on a heavy base plate 156 for stability.

The test rig 140 is designed so that the two expanding linkages 142, 144 can be moved separately. The mechanical structure is constructed so that manual rotation is possible with the help of dials at the ends of the lead screws 150 or with the help of motor operation. Conveniently, a separate motor can be provided at the end of each lead screw. To reduce the friction for the expansion of the linkages, the test rig may be adapted so that the lower expansion linkage 142 runs on a slope.

A plastic sheet (not shown) provides the cylindrical surface, and is anchored to one of the tubes 154 connecting the top and bottom expanding linkages 142, 144. To reduce the friction between the plastic sheet and these tubes 154, the tubes 154 are made to rotate on bearings 158 fixed at the ends of the tubes 154. The sheet is held against the rotatable tubes by suitable screws, such as three elastic bands at the top, middle and the bottom of the cylindrical surface.

In this testing machine the surface profile is a function of the initial position, and the revolutions of the motors. A suitable sensor system, such as the Oxford Pressure Monitor (RTM) discussed above, can be used in conjunction with the test rig.

Figure 16:
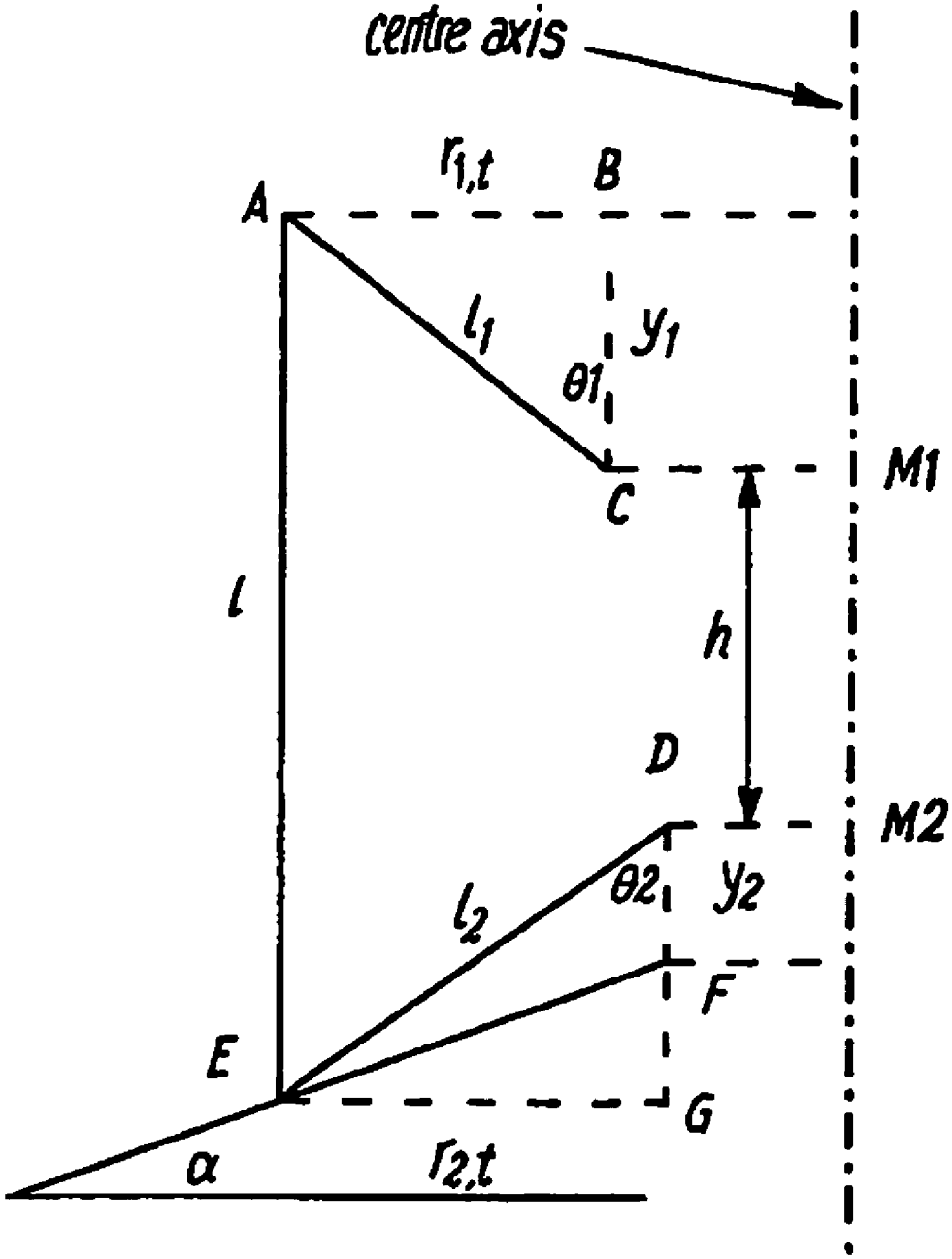
FIG. 16 is a schematic diagram of portions of the test rig of FIG. 14 showing parameters used in a mathematic description of the mechanics of the operation of the test rig.

The mechanics of the operation of this test rig are derived below using the nomenclature depicted in FIG. 16.

Notations:

| | |
|---|---|
| $\alpha$ | angle of the slope |
| p | pitch of the lead screw |
| $R_{2,t}$ | Lower radius of the final surface at time t |
| $R_{1,t}$ | Upper radius of the final surface at time t |
| Thickness | Thickness of the sheet |

Dimensions of the test-rig linkage required for the mechanics model;

| | |
|---|---|
| DM2 = | 31.2 mm |
| CM1 = | 31.2 mm |
| $l_1$ = | 136.5 mm |
| $l_2$ = | 136.5 mm |
| $\alpha$ = | $12^0$ 15' |
| Pitch (p) = | 4 mm |
| l = | 334 mm |
| h = | 68.5 mm |

Initial radius of the cylinder $$R_{1,0}=76.39 \text{ mm}$$

$$R_{2,0}=76.39 \text{ mm}$$

$$r_{2,t}=R_{lower}-DM\ 2-\text{Thickness}$$

$$r_{1,t}=R_{upper}-CM\ 1-\text{Thickness}$$

General equation using the Sine Theorem $$\frac{r_{2,t}}{\text{Sin}\theta_{2,t}\times\text{Cos}\alpha}=\frac{y_{2,t}}{\text{Cos}(\theta_{2,t}+\alpha)}=\frac{l_2}{\text{Cos}\alpha}$$

$$\theta_{2,t}=\text{Sin}^{-}\left(\frac{r_{2,t}}{l_2}\right)\times\frac{180}{\pi}$$

$$y_{2,t}=\frac{l_2}{\text{Cos}\alpha}\times\text{Cos}(\theta_{2,t}+\alpha)$$

-continued $$\theta_{2,0}=\text{Sin}^{-}\left(\frac{r_{2,0}}{l_2}\right)\times\frac{180}{\pi}$$

From this, considering the initial state $$y_{2,0}=\frac{l_2}{\text{Cos}\alpha}\times\text{Cos}(\theta_{2,0}+\alpha)$$

$$y_{downward}=y_{2,0}-y_{2,t}$$

$$\text{Lower motor clock pulses}=\frac{2000}{p}\times y_{downwards}$$

Lower motor clock pulses is the nearest whole number from the above calculation. Accordingly the "effective $y_{downward}$" is calculated from the reverse calculation. For a right cylinder the corresponding position of the point A is given by $$r_{1,t}=r_{2,t}$$

$$y_{upward}=[l-(l_2\ \text{Cos}\ \theta_{22})]-[l-(2\times l_2\ \text{Cos}\ \theta_{20})+(r_{22}\times\text{Tan}\ \alpha)+y_{20}]$$

Hence $$\text{Upper motor clock pulses}=\frac{1000}{p}\times y_{upward}$$

Here too upper motor clock pulses is the nearest whole number.

This clock pulse information is used to turn the two stepper motors at the top and the bottom of the test rig to form a right circular cylinder of the required diameter.

The 3-D strain, radius of curvature and pressure information are collected by mounting fabric tubes of different circumferences on the test-rig surface. These data are used in a MatLAB software programme to represent the pressure profile on the contact surface.

Special yarns, of polymer and/or metal, which have linear or non-linear tension/extension characteristics, may be used in the manufacture of pressure garments according to the invention.

The invention claimed is:

1. A method for making a pressure garment, the method comprising the steps of:

defining the shape and dimensions of a garment by generating a 3D image of the shape the garment has to fit;

defining the pressure profile characteristics of the garment;

specifying a knitting pattern for the garment;

calculating yarn feed data for the knitting pattern to produce the defined shape and pressure profile characteristics;

calculating the number of needles per course reciuired to achieve the defined pressure characteristics; and, knitting the garment according to the knitting pattern, the yarn feed data, and the calculated number of needles per course.

2. The method according to claim 1, in which the 3D shape and dimensions are defined with reference to data derived from scanning the body or part thereof for which the garment is intended.

3. The method according to claim 1 in which the pressure characteristics are defined by medical considerations.

4. The method according to claim 1 in which the shape and pressure profile or characteristics are defined in a CAD system for calculating yarn feed data and for a selection of a knitting pattern.

5. The method according to claim 4, in which the 3D shape is defined in an environment which is remote from the CAD system.

6. The method according to claim 4 in which the CAD system-calculated yarn feed data and the knitting patterns are transmitted to a manufacturing operation.

7. The method according to claim 6, in which the manufacturing operation is remote from the CAD system.

8. The method according to claim 1 in which point cloud data representing shape and dimensions are processed to generate an image of the shape and dimensions the garment has to fit, and pressure characteristics are used to calculate machine and/or knitting parameters.

9. The method according to claim 8 in which the point cloud data are used to calculate the number of needles per course for knitting the garment.

10. The method according to claim 1 in which the garment is knitted on a flat bed knitting machine.

11. The method according to claim 1 in which a servo motor controlled feed system is controlled for the formation of each stitch, tuck or float of the knitting pattern according to the yarn feed data.

12. The method according to claim 1 in which the garment is manufactured as a 3D seamless garment.

13. A pressure garment made by the method according to claim 1.

14. A pressure stocking made by the method according to claim 1.

15. The method according to claim 1 in which the garment is knitted with an elastomeric yarn.

16. The method according to claim 15 in which the elastomeric yarn comprises an elastomeric core yarn and substantially inelastic outer yarn which sheathes the core yarn.

17. The method according to claim 2 in which surface boundary lines representing the 3D shape and dimensions of the body or part thereof for which the garment is intended are defined.

18. The method according to claim 17 in which the surface boundary lines are defined using a polynomial function.

19. The method according to claim 17 in which a course path representing the courses of the knitted garment is defined and mapped onto the surface boundary lines.

20. The method according to claim 19 in which a polynomial function is used to define the course path.

21. The method according to claim 1 in which the defined pressure profile characteristics are produced by controlling yarn strain in the courses of the knitted garment.

22. The method according to claim 21 in which yarn strain is controlled by controlling the course lengths in the knitted garment.

23. The method according to claim 21 in which yarn strain is controlled by controlling the number of needles knitted in each course.

24. The method according to claim 1 in which the garment is knitted to produce a knitted structure having stitches and tucks.

25. The method according to claim 24 in which the knitted structure comprises alternate stitches and tucks.

26. An apparatus for making pressure garments comprising:

a scanning means for deriving shape characteristics defining a 3D image of a body for which a garment is intended;

a data processing means for receiving pressure characteristics of the garment, and for calculating yarn feed data for a specified knitting pattern based on said 3D image and said pressure characteristics, the data processing means being operative to calculate the number of needles per course required for knitting the garment to achieve said pressure characteristics;

a knitting machine; and, a yarn delivery system for the knitting machine, the data processing means controlling the knitting machine and the yarn delivery system to knit the garment according to the knitting pattern and the yarn feed data.

27. The apparatus according to claim 26 in which the knitting machine is a flat bed machine.

28. The apparatus according to claim 26 in which the knitting machine is remote from the data processing means, with a data link of some description, for example, e-mail, transmitting the data to the knitting machine.

29. A method for making a pressure garment, the method comprising the steps of:

defining 3D shape and pressure profile characteristics of a garment;

specifying a knitting pattern for the garment;

calculating yarn feed data for the knitting pattern to produce the defined shape and pressure profile characteristics; and, knitting the garment according to the knitting pattern and the yarn feed data, while controlling a servo motor feed system for the formation of each stitch, tuck or float of the knitting pattern according to the yarn feed data.

30. An apparatus for making pressure garments comprising:

a data processing means adapted to calculate yarn feed data for a specified knitting pattern based on defined 3D shape and pressure profiles and pressure characteristics of a garment;

a knitting machine and a yarn delivery system controlled to knit the garment according to the knitting pattern and the yarn feed data; and, a servo motor controlled feed system for the formation of each stitch, tuck or float of the knitting pattern according to the yarn feed data.

31. The apparatus according to claim 30 further comprising a scanning means for deriving shape characteristics from the human or animal body for which the garment is intended.

32. The apparatus according to claim 31, in which the scanning means is remote from the data processing means, information about the shape characteristics together with prescribed pressure profile and characteristics being transmitted to the data processing means by any suitable link.

33. The apparatus according to claim 31 in which the scanning means collects point cloud data representing shape characteristics from the human or animal body the garment is intended for.

* * * * *